United States Patent [19]

Nielsen et al.

[11] Patent Number: 4,829,418

[45] Date of Patent: May 9, 1989

[54] APPARATUS AND METHOD FOR CONTROLLING A HYDRAULIC EXCAVATOR

[75] Inventors: Edward G. Nielsen; Timothy E. Steenwyk, both of Grand Rapids, Mich.

[73] Assignee: Laser Alignment, Inc., Grand Rapids, Mich.

[21] Appl. No.: 42,449

[22] Filed: Apr. 24, 1987

[51] Int. Cl.[4] ..... E02F 3/00

[52] U.S. Cl. ..... 364/167.01; 172/4.5; 37/DIG. 1

[58] Field of Search ..... 364/167; 172/4.5; 37/DIG. 1, DIG. 19, DIG. 20

[56] References Cited

U.S. PATENT DOCUMENTS

| | | | |
|---|---|---|---|
| 3,708,232 | 1/1973 | Walsh | 356/172 |
| 3,727,332 | 4/1973 | Zimmer | 37/97 |
| 3,813,171 | 5/1974 | Teach et al. | 356/152 |
| 3,887,012 | 6/1975 | Scholl et al. | 37/86 |
| 3,997,071 | 12/1976 | Teach | 214/761 |
| 4,034,490 | 7/1977 | Teach | 37/86 |
| 4,050,171 | 9/1977 | Teach | 37/86 |
| 4,129,224 | 12/1978 | Teach | 214/763 |
| 4,162,708 | 7/1979 | Johnson | 172/4.5 |
| 4,231,700 | 11/1980 | Studebaker | 414/700 |
| 4,273,196 | 6/1981 | Etsusaki et al. | 172/4.5 |
| 4,286,386 | 9/1981 | Long | 33/138 |
| 4,288,196 | 9/1981 | Sutton, II | 414/699 |
| 4,413,684 | 11/1983 | Duncklee | 172/4.5 |
| 4,452,078 | 6/1984 | Formanek et al. | 73/432 |
| 4,535,699 | 8/1985 | Buhler | 104/7 B |

FOREIGN PATENT DOCUMENTS 2101077 6/1983 United Kingdom .

OTHER PUBLICATIONS

Hitachi Computing Monitor HCM-1, KO-EO43, Printed in Japan (86.1.2000 JEC), Brochure: "Off To New Frontiers of Performance", O&K.

*Primary Examiner*—Allen MacDonald

*Attorney, Agent, or Firm*—Price, Heneveld, Cooper DeWitt & Litton

[57] ABSTRACT

A control for an excavator controls the position of the bucket cutting edge to a desired depth accurately by a calibrating laser receiver mounted on the excavator stick member and passed through a stationary laser plane wherever the stick is moved into or out of a trench. Linear position encoders monitor the length that the actuating cylinders are extended and lookup tables convert the encoder outputs to angle representations for determining the positions of the laser receiver and the cutting edge. Other lookup tables are utilized to avoid time-consuming iterative calculation procedures to provide real-time digital process solutions of trigonometric functions. The apparatus includes a unique laser receiver comprising a plurality of linearly aligned photo receptors with associated circuitry for producing an output representative of the receptor illuminated or, if a group of receptors are illuminated, the centermost receptor illuminated.

23 Claims, 15 Drawing Sheets

MANUAL CALIBRATE BUTTON

APPARATUS AND METHOD FOR CONTROLLING A HYDRAULIC EXCAVATOR

BACKGROUND OF THE INVENTION

This invention relates to a control for a hydraulic excavator and in particular to an excavator control of the type that is used in conjunction with a laser generator capable of generating a laser beam or plane.

The use of lasers to automatically control earth moving equipment is known in the construction industry. Some limited success has been achieved in controlling bulldozer blade elevations as well as controlling the blade elevation of motor graders. One piece of construction equipment that has eluded successful application of a laser is the excavator. A desirable attribute for an excavator would be one that could easily and quickly dig exactly to a finished grade at a desired depth without the requirement for frequent operator checks or for requiring additional workers in the area. The system should be easy to operate and function properly even though the excavator changes its elevation and attitude frequently. In addition, an excavator should allow the operator to dig to a level grade or to a nonlevel grade having a desired slope or percent of grade.

Several attempts have been made at such an excavator control but all have had serious disadvantages. For example, in U.S. Pat. No. 4,129,224 issued to Ted L. Teach for an AUTOMATIC CONTROL OF BACKHOE DIGGING DEPTH, a laser beam sensor unit is mounted on the end of a pendular mast pivotally mounted by the boom pivot pin. A vertical motor continuously adjusts the vertical height of the mast to keep the laser beam sensor in the plane of the laser beam. A transducer monitors the amount of extension of the mast and produces an electrical signal proportional to the height of the mast and hence proportional to the absolute vertical spacing between the pivot axis of the boom and the laser plane. Angular displacement transducers monitor the angles between the backhoe frame and the boom, between the boom and the stick and between the stick and the bucket. The position of the bucket cutting teeth with respect to the backhoe can be determined as a trigonometric relationship between the three angles. By combining the distance from the laser receiver to the backhoe and from the backhoe to the cutting edge the true depth of the cut should be determinable.

Such a device has several drawbacks. The laser height-seeking detector requires a mast, that not only extends above the excavator and is therefore vulnerable to damage, but also requires means such as pendular mounting to maintain the mast vertically aligned. In a conventional excavator, the boom pivot is typically disposed under the cab or other obstruction, so application of a mast becomes impractical. In addition, a beam-seeking drive motor and transducer are required. Further, while the angular displacement transducers may lend themselves well to implementation in a control using analog circuits, such circuits may be ambient temperature sensitive and the trigonometric relationships between the cutting edge of the bucket and the transducer outputs makes direct conversion to digital control prohibitive. The reason this is prohibitive is that a digital computer traditionally performs trigonometric calculations by successive approximation, an iterative trial and error process. While such calculations pose no problem in the laboratory setting, they are much too slow for real-time control of a dynamic machine such as an excavator.

In U.S. Pat. No. 4,231,700 issued to Robert H. Studebaker for a METHOD AND APPARATUS FOR LASER BEAM CONTROL OF BACKHOE DIGGING DEPTH, the laser receiver is mounted to the stick member rather than on the end of a pendular mast. However, just as with Teach '224, the laser receiver must at all times stay in contact with the laser beam to function. Studebaker suggests that by directing a laser beam along a plane that is a predetermined elevation with respect to the desired dig depth, a manual or automatic control could be made to cause the cutting edge of the bucket to dig to a predetermined depth. While some of the difficulties of the previous devices are overcome, the limitations of this device are apparent. The location of the laser plane is extremely inflexible. If even a moderately-deep ditch is being dug, the laser plane must be located below ground level. Further, the other difficulties inherent in Teach '224 are not even addressed in Studebaker.

Other solutions have been suggested, but they all require that the position of the excavator be located with a transit and relocated every time the frame moves. This not only is a time-consuming task but the precise position of the frame is subject to frequent and often abrupt changes during the operation of the excavator. As a result, digging progress is not only slow but is also likely to be inaccurate.

SUMMARY OF THE INVENTION

The present invention provides a method and apparatus for controlling an excavator to position the cutting edge, during a cut, to a desired depth with extreme accuracy. The present invention is used in conjunction with a laser plane generator that generates a laser plane and which repetitively calibrates the reference coordinate system of the excavator every time the digging stick passes through the laser plane. In this manner, the control will be frequently and repetitively calibrated as the excavator hauls bucket-loads of dirt out of the ditch and will thus compensate for frequent movement of the excavator frame without requiring time-consuming reestablishment of the frame location. Further, the present invention utilizes an improved control technique for controlling the cutting edge, in relationship to the angular relationship between the various members of the excavator, in a very fast and efficient manner using digital processing techniques. Further, an improved technique for monitoring these angles provides a significantly more accurate determination of the position of the cutting edge than has before been possible. In addition, the control of the present invention is capable of digging to a nonlevel grade as well as to a level one.

According to the invention, the control has means for monitoring the angle of displacement of the excavator from a vertical plane and the various angles between the members of the excavator and means for determining the position of th bucket cutting edge from these angles. A laser receiver is mounted on the stick member and is passed through the laser plane every time the stick is brought out of or put into a trench. The control determines the position of the laser receiver with respect to the excavator frame at the precise moment that the receiver detects the laser beam. This information is used to determine the location of the excavator frame with respect to the laser beam. The position of the bucket cutting edge with respect to the laser plane can therefore be accurately determined and is compared to a desired cutting distance with respect to the laser plane to operate the means that actuates the cutting edge.

The location of the laser receiver on the stick provides other advantages besides the ability to recalibrate the location of the frame every time the stick is moved into or out of the ditch. For instance, the position of the cutting means is determined by monitoring the angles between the frame and true vertical, between the frame and the boom, between the boom and the stick and between the stick and the bucket. The position of the laser receiver, at the moment that it is struck by a beam, is determined by monitoring the angles between the frame and true vertical, between the frame and the boom and between the boom and the stick. Because many of the same angles are included in both determinations, any errors that occur in monitoring these angles tend to be cancelled out in the calibration process.

A laser plane transmitter produces a very narrow beam that revolves in a plane at a typical frequency of 12 revolutions per second. Therefore, a single photo receptor mounted to a stick could pass through the laser plane and not be struck by the laser beam. To resolve this problem, the laser receiver of the invention is made up of a plurality of photo receptors linearly arranged in an array having a generally vertical orientation. At least one receptor in the array of the laser receiver will always be struck by the rotating beam and, should more than one receptor be struck, means are provided to determine the location of the single receptor that is centermost in the group of receptors that is struck.

Every time that the laser receiver is struck by a laser beam, the control is calibrated and considered to thereafter be in a calibrated mode. If a predetermined amount of time passes since the last calibration, or if the frame experiences a significant amount of movement that may indicate the previous calibration is no longer valid, the control enters a noncalibrated mode wherein automatic control ceases and the operator is informed thereof. The control can then be recalibrated by moving the stick through the laser beam.

Although the invention lends itself to implementation in many forms, in the preferred mode the control will only guide the positioning of the cutting edge during approximately the last 6 inches of the cut. When the bucket is in other positions, the excavator is controlled by manual operation. When the operator brings the cutting edge to within 6 inches of the desired depth, an indicator light will illuminate and the automatic control will take over. However, even when the cutting edge is within 6 inches of the desired depth, the operator will always be able to override the automatic control, if desired. In addition, any time the control detects an excessive tilting of the frame, that may indicate the existence of a dangerous condition such as the bucket being lodged against an immovable object, the control will be immediately removed from the automatic mode. It is additionally contemplated that the present invention could be combined with other known control techniques that provide for memorizing certain repetitive routines such as dumping a bucket of dirt into a truck.

In addition to digging precisely to a predetermined depth on the level, the present invention can cut on a sloping grade, such as needed for laying drain tile or the like. Just as the control provides precise monitoring of the generally vertical coordinate of the position of the cutting edge, the control is also capable of precise determination of the generally horizontal coordinate of the cutting edge position. The previously described calibration method is utilized to determine both the vertical and horizontal components of the distance between the laser receiver and the frame at the moment the receiver crosses the laser plane. Therefore, the control will be aware of the distance that the cutting edge is below the laser plane and horizontally away from the point where it was when the laser receiver crossed the laser plane. By continually adjusting the desired depth for the changing cutting edge horizontal position and desired percent of grade, the cutting edge can be guided on a precise slope. Additionally, it is contemplated that the laser plane would be inclined to match the desired percent of grade, so the desired depth would be recalibrated every time the receiver crosses the laser plane just as it is when cutting on the level.

Angular displacement transducers of superior accuracy have been developed. However, because the position of the cutting edge is determined by monitoring four successive angles, even small errors in angular measurement rapidly compound. The invention comprehends monitoring the angles between the frame and the boom, between the boom and the stick and between the stick and the bucket in a manner which is significantly more accurate than the use of angular displacement transducers. In a hydraulic excavator, linearly extending hydraulic cylinders are utilized between the members to actuate or rotate the members about mutually coupling pivot means. For example, a boom cylinder between the frame and the boom actuates the boom. To determine the angle between the boom and the frame according to the invention, a linear displacement transducer monitors the linear extension of the boom cylinder relative to its retracted position. The relationship between the extension of the boom cylinder and the angular displacement of the boom is a readily determinable, trigonometric relationship. Because the invention provides for the rapid digital solution to trigonometric functions, it is able to convert the cylinder extension to angular displacement in real-time. Because a proportionately greater degree of accuracy can be obtained in the measurement of the amount of cylinder displacement compared to the angular rotation, greater overall accuracy is achieved.

As previously mentioned, the absolute position of the cutting edge is a trigonometric function or equation of the four previously discussed angles. While the equation is not a difficult one to solve manually, or by using an analog computer, a digital computer normally utilizes an iterative, and therefore slow, approximation process to provide a solution. To provide sufficiently rapid solution to these equations to effect real-time control, the control of the invention combines the four angles into three representations or numbers. For each of the three representations or numbers, the control utilizes a lookup table that contains the corresponding value of the cutting edge position component that relates to the representation for every unique value of the representation. Thus, the angles between the frame and vertical and between the boom and the frame are combined to provide a first representation and a lookup table is used to obtain the value of the component of the cutting edge corresponding to this representation. A second lookup table is associated with a second representation that is a combination of the first representation and the angle between the boom and the stick. Yet a third lookup table is associated with a third representation that is a combination of the second representation and the angle between the stick and the bucket. The control repetitively samples the register storing the respective representation, or number, looks up the corresponding value of the component of the position of the cutting edge that relates to that representation or number and combines the values obtained from the three lookup tables to determine the position of the cutting edge by mere arithmetical manipulation. In a like manner, a lookup table is utilized in association with each hydraulic cylinder to provide a corresponding angular displacement for each and every possible value of linear extension of the cylinder. Therefore, a total of six lookup tables is required to rapidly and accurately determine either the vertical or horizontal components of the position of the cutting edge. For example, a first lookup table associated with the hydraulic cylinder between the frame and the boom converts the amount of extension of the cylinder to an angular displacement. A second lookup table converts the angular displacement, corrected for frame tilt, to a vertical component of the cutting edge that relates to that corrected angle. In a like manner, two lookup tables are associated with the rotation between the boom and the stick and two lookup tables are associated with the rotation between the stick and the bucket. If three additional lookup tables are provided to convert the respective three representations that are combinations of angular displacements to the horizontal component, both vertical and horizontal components can be accurately and rapidly determined using only nine lookup tables.

Each lookup table will necessarily store a large quantity of numbers, on the order of 50,000. However, this is not particularly vexatious because memory devices much larger than this are commercially available. Because the equations relating the length of the cylinders to the amount of angular displacement and relating the amount of angular displacement to the position of the bucket are readily solvable in the laboratory using conventional techniques, the lookup table can be constructed in a manner that is well within the capabilities of one skilled in the art.

These and other related objects, advantages and features of this invention will become apparent upon review of the following specification in conjunction with the drawings.

DESCRIPTION OF THE PREFERRED EMBODIMENT

Figure 1:
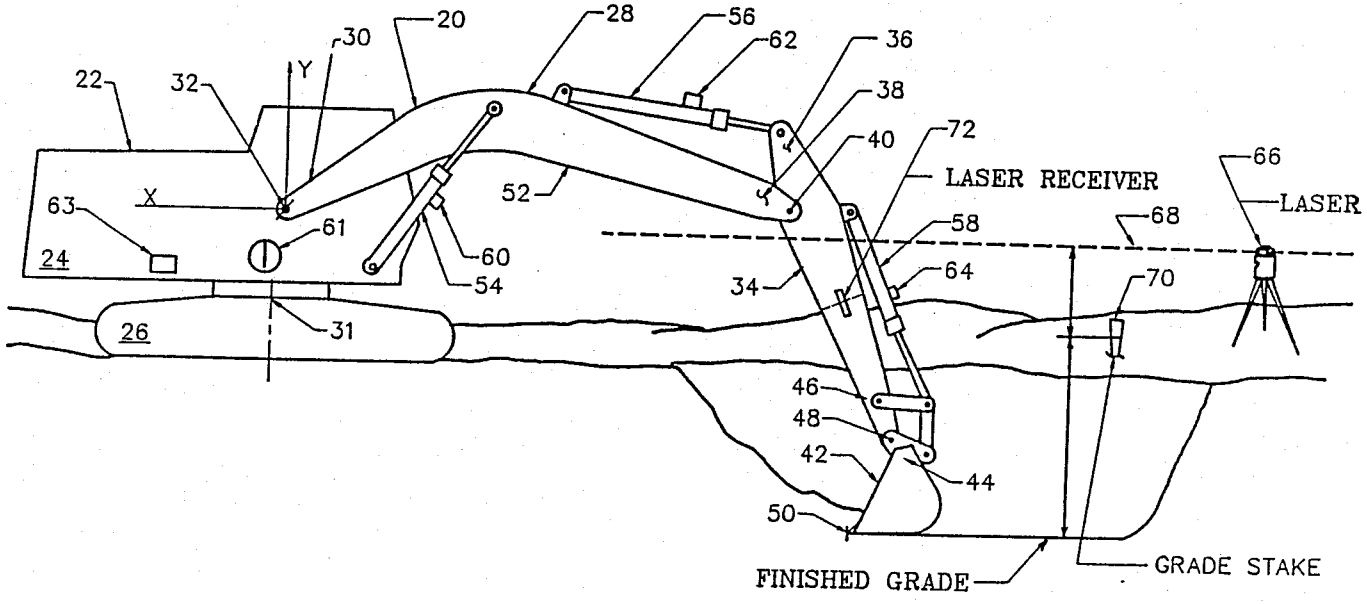
FIG. 1 is a side elevational view of an excavator and a laser transmitter in their intended environment controlled according to the invention.

For the purpose of illustration, the term "X-coordinate" will be used to designate a distance from a reference coordinate in a generally horizontal plane. However, such reference is not in relationship to earth horizontal unless so specified. Similarly, the reference to "Y-coordinate" refers to a measure of distance that is perpendicular to the X axis and will be in a generally vertical direction. However, this is not intended to refer to earth vertical unless so stated. Any reference to the front of the excavator is to indicate the portion to which the boom is attached. Any reference to Origin is to the center of boom pivot 32.

The variables used in the description are defined in Table I.

TABLE I

VARIABLES

| DESIGNATION | EXPLANATION | SOURCE |
|---|---|---|
| CYLBOOM | Length Boom Cylinder Extended | Input From Linear Encoder |
| CYLSTIK | Length Stick Cylinder Extended | Input From Linear Encoder |
| CYLBUCK | Length Bucket Cylinder Extended | Input From Linear Encoder |
| ANGVERT | Angle Between True Vertical and Frame | Input From Verticality Sensor |
| RABOOM | Angle Between Frame and Boom | Lookup Table |
| RASTIK | Angle Between Boom and Stick | Lookup Table |
| RABUCK | Angle Between Stick and Bucket | Lookup Table |
| ANGBOOM | Angle of Boom Relative to True Horizontal | Calculated |
| ANGSTIK | Angle of Stick Relative to True Horizontal | Calculated |
| ANGBUCK | Angle of Bucket Relative to True Horizontal | Calculated |
| HTBOOM | Vertical Distance From Origin to stick Pivot Point 40 | Lookup Table |
| HTSTIK | Vertical Distance From Stick Pivot Point to Bucket Pivot Point 48 | Lookup Table |
| HTBUCK | Vertical Distance From Stick End Pivot Point to Cutting Edge | Lookup Table |
| DSLSR | Distance From Centermost Cell, Struck by the Laser, in the Laser Sensor to the Reference Point on the Stick | Input From Laser Receiver |
| HTLSR | Vertical Distance From Reference Point on Stick to laser Plane | Lookup Table |
| LNSTIK | Length of Stick From Boom End to Laser Sensor Reference Point | Constant |
| HTREL | Vertical Distance From Origin to the Cutting Edge | Calculated |
| HTORIG | Vertical Distance of the Origin Below The Laser Plane | Calculated |
| HTACT | Vertical Distance of Cutting Edge Below Laser Plane | Calculated |
| HTTRGT | Desired Vertical Depth of Final Cut From Laser Plane | Input From Control Panel |
| GDTRGT | The Variable Desired | Calculated |

TABLE I-continued

| VARIABLES | | |
|---|---|---|
| DESIGNATION | EXPLANATION | SOURCE |
| | Depth of Final Cut From Laser Plane Continually Adjusted According to Current HTACT and PERGRAD | |
| PERGRAD | Desired Percent of Grade of Final Cut | Input From Control Panel |
| WDBOOM | Horizontal Distance From Origin to Boom End Pivot Point | Lookup Table |
| WDSTIK | Horizontal Distance From Boom End Pivot Point to Stick End Pivot Point | Lookup Table |
| WDBUCK | Horizontal Distance From Stick End Pivot Point to Cutting Edge | Lookup Table |
| WDORIG | Horizontal Distance From the Origin to the Cutting Edge at the Instant the laser Receiver Contacts the Laser Beam | Calculated |
| WDREL | Horizontal Distance From the Origin to the Cutting Edge | Calculated |
| WDACT | Horizontal Distance of Cutting Edge From Its Position at the Instant the Laser Receiver Contacts the Laser Beam | Calculated |
| CDBOOM | Length Boom Cylinder Extended At Instant of Laser Beam Contact | Input From Linear Encoder |
| CDSTIK | Length Stick Cylinder Extended at Instant of Laser Beam Contact | Input From Linear Encoder |
| CDBUCK | Length Bucket Cylinder Extended at Instant of Laser Beam Contact | Input From Linear Encoder |
| CAVERT | Angle Between True Vertical and Frame at Instant of Laser Beam Contact | Input From Verticality Sensor |
| CBDIST | Assigned Number of Median Laser Receptor Cell Illuminated by Laser | Input From Laser Receiver |
| CABOOM | Angle Between Frame and Boom at Instant of Laser Beam Contact | Lookup Table |
| CASTIK | Angle Between Boom and Stick at Instant of Laser Beam Contact | Lookup Table |
| CABUCK | Angle Between Stick and Bucket at Instant of Laser Beam Contact | Lookup Table |

Referring now specifically to the drawings, and the illustrative embodiments depicted therein, FIG. 1 shows an excavator 20 having a frame 22 which consists of a cab member 24 horizontally pivoted about a tread member 26. A boom 28 is pivotally mounted at a proximal end 30 to cab 22 by pivot means 32. A stick 34 is pivotally mounted at a proximal end 36 to a distal end 38 of boom 28 by pivot means 40. A bucket 42 is pivotally mounted at a proximal end 44 to a distal end 46 of the stick by a pivot means 48. A distal end of the bucket 42 defines a cutting edge 50 which is used to excavate dirt in response to movement of bucket 42 towards the frame 22. Boom 28, stick 36, and bucket 42 make up connecting means 52 for connecting the cutting edge 50 to frame 22.

A first linearly extendable device, such as a hydraulic cylinder 54, connected between the frame and the boom provides means for pivotally moving the boom with respect to the frame. A second linearly extendable device, such as hydraulic cylinder 56, provides means for pivotally moving the stick 34 with respect to the boom. A third linearly extendable device, such as hydraulic cylinder 58, provides means for pivotally moving the bucket 42 with respect to the stick. Hydraulic cylinders 54, 56 and 58 provide actuation means for moving the cutting edge 50 with respect to frame 22.

A first encoder 60 produces a signal or representation proportional to the distance that hydraulic cylinder 54 is extended from its fully retracted position. A second encoder 62 produces a signal or representation proportional to the length that second hydraulic cylinder 56 is extended from its fully retracted position. A third encoder 64 provides a signal or representation proportional to the distance that third hydraulic cylinder 58 is extended from its fully retracted position. The operation of encoders 60, 62 and 64 will be explained in detail below.

A verticality sensor 61 mounted on frame 22 provides a signal or representation proportional to the amount of deviation between the frame 22 and the earth's horizontal plane. In other words, verticality sensor 61 measures the degree to which frame 22 is not level in its front-to-back reference plane. Verticality sensor 61 is typically a rheostat operated by a weighted pendulum and is available from Humphrey Inc. as Model No. CP17-1101-1. Also provided on frame 22 is a motion detector 63, which is a pressure switch for monitoring the hydraulic lines that control the track movement. Detector 63 determines that the operator has activated the manual control that causes the track motor to operate and the excavator to move.

FIG. 1 shows the excavator 20 in use with a laser generator 66. Laser 66 produces a narrow beam at a predetermined frequency that revolves in a plane at typically about 12 revolutions per second. With laser 66 properly aligned with respect to the true horizontal orientation of the earth's surface, it will produce a generally horizontal laser plane 68 but the invention comprehends use of an excavator with a laser plane that is nonhorizontal as well. Such a laser is well-known in the art of surveying and grading and the specific construction thereof forms no part of the invention. Such a laser is sold by Laser Alignment Incorporated of Grand Rapids, Mich. under Model No. 5000.

Also shown, but not forming a portion of the invention, is a grade stake 70 which is placed in the ground by a surveying team during establishment of the work site and provides a bench mark elevation with respect to which the desired depth of various trenches and holes is measured.

An incremental laser receiver 72 is mounted to stick 34 in a position where it will intersect laser plane 68 substantially every time that the bucket 42 is withdrawn from or inserted into a trench during the normal course of emptying a load of dirt from the bucket 42. The structure and function of laser receiver 72 will be explained in more detail below.

Figure 2:
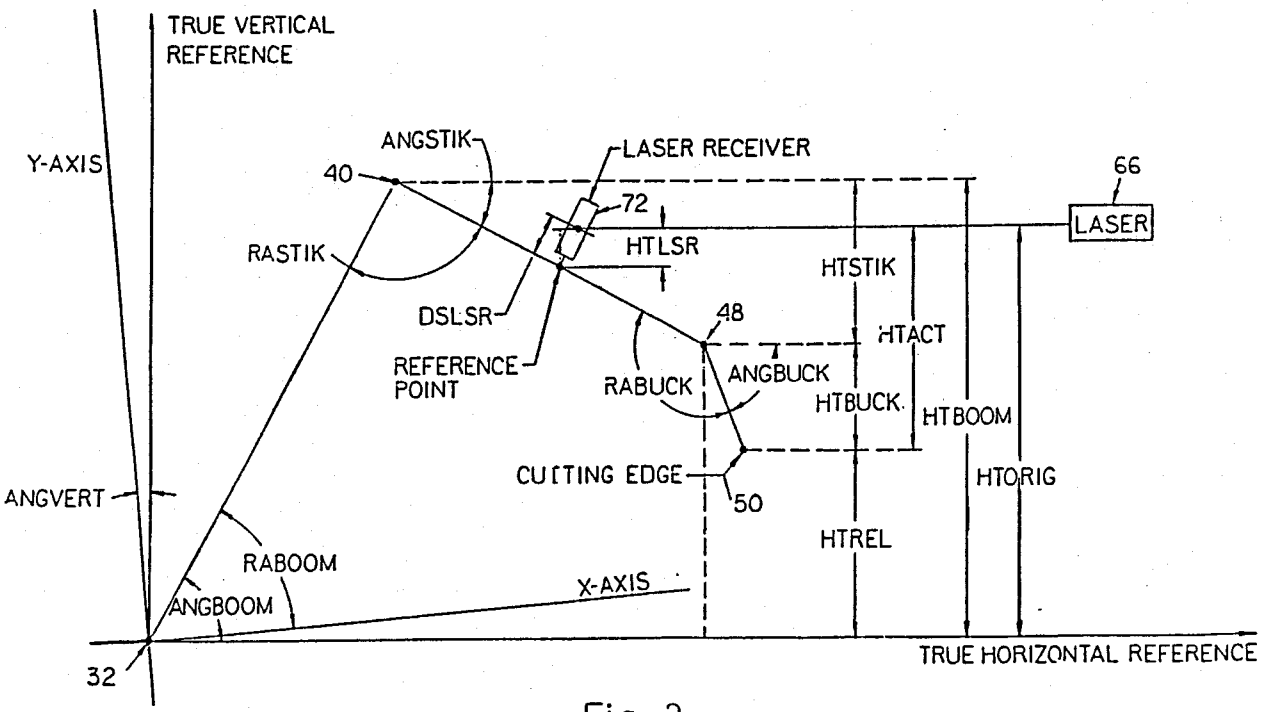
FIG. 2 is an abstraction of the elements of the excavator to illustrate their geometric relationship.

FIG. 2 shows a schematic representation of an excavator 20 performing an excavation operation. The two relevant coordinate systems are shown. First, there is the earth coordinate system which has a true horizontal reference coordinate, which is parallel to the earth's surface and a true vertical reference coordinate, which is essentially perpendicular to the earth's surface. The second coordinate system is defined with respect to the excavator frame 22. An X axis is defined to be parallel to the base or track of the frame 22. The Y axis is defined as being perpendicular to the X axis in a generally upward direction. The origin of the X-Y coordinate system is the center of boom pivot means 32. Under most circumstances the frame 22 will not be perfectly level and therefore the X-Y coordinate system will not coincide with the earth coordinate reference system.

FIG. 2 illustrates the physical meaning of the variables in Table I as they apply to these two coordinate systems. It can be seen that the three angular measurements RABOOM, RASTIK and RABUCK are all monitored with respect to the frame of the excavator. The position of the cutting edge with respect to the origin could be precisely determined by accurate measurement of these three variables. However, what is relevant is the variable HTACT, which describes the relationship or distance between the cutting edge and the laser plane, which is set up at a predefined relationship to the earth coordinate system. This variable also requires knowledge of the angle between the frame and true vertical and the distance between the laser plane and the origin.

As will be explained in more detail below, laser receiver 72 is periodically passed through the plane generated by laser 66 and, at the instant of the beam contacting the receiver, the control computes HTLSR, the vertical distance between the centermost receptor cell of the group of cells that the beam strikes and a reference point on the stick, as well as the vertical height of the reference point on the stick with respect to the boom and the vertical height of the boom with respect to the origin. The control is then able to precisely determine the variable HTORIG, which is the true vertical distance between the laser plane and the center of the boom pivot means 32, which is the origin of the X-Y coordinate system. This number is stored and, until recalculated during the next pass of the laser receiver through the laser plane, serves as a calibration number. By continuously comparing the calculated height of the cutting edge with the calibration number previously calculated and stored, the control can determine at all times, during which the system is calibrated, the precise vertical distance between the cutting edge and the laser plane. This variable, HTACT is used as a control variable to cause the actuation means to move the cutting edge to a desired distance from the laser plane.

LASER RECEIVER

Figure 4:
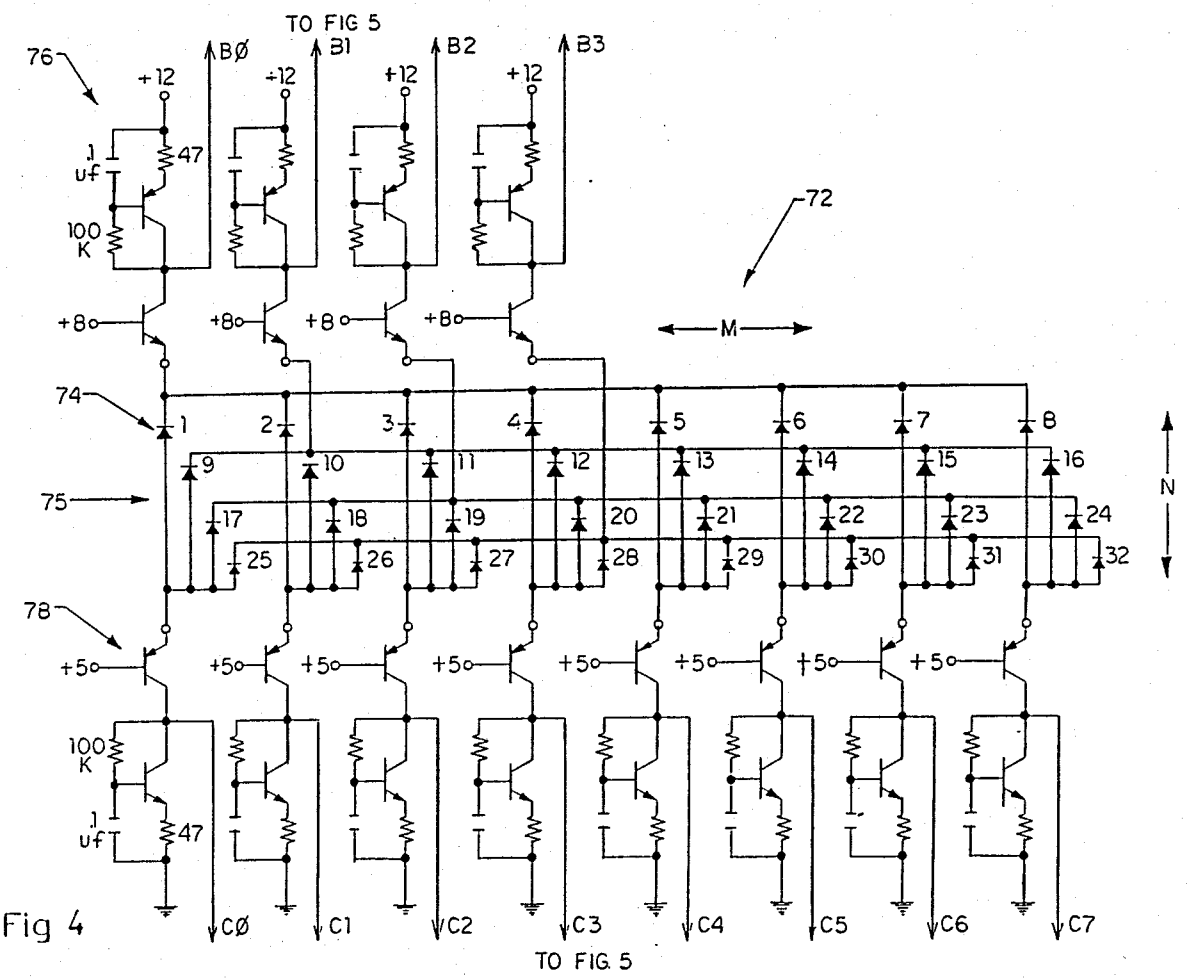
FIG. 4 is a schematic diagram of the array of photo receptors in the laser receiver.

Referring to FIG. 4, incremental laser receiver 72 has, in the illustrated embodiment, has a quantity of 32 photo receptors or cells 74 which respond to the frequency of light emitted by laser 66 by reducing their impedance. The 32 receptors 74 are assigned consecutive integer numbers 1–32 for a reason to be explained below. The receptors assigned numbers 1–32 are arranged in a straight line, or linear array with adjacent receptors having consecutively assigned numbers. Therefore, if receptor #1 is at the top of the line, receptor #32 would be at the bottom or vice versa. Of course, the specific quantity of receptors used may be increased or decreased for application to different excavators.

It can be seen from FIG. 4 that the receptors are electrically interconnected in a matrix made up of N rows and M columns of interconnections. Each receptor 74 is located at a unique intersection of a particular column and row. Each row N is connected to a corresponding amplifier 76 and each column M is connected to a column amplifier 78. When a particular receptor is illuminated by light at the appropriate frequency, the corresponding output terminal B0 through B3 of the appropriate row amplifier 76 decreases in voltage and the appropriate output terminal C0 through C7 of the corresponding column amplifier 78 increases in voltage.

Figure 5:
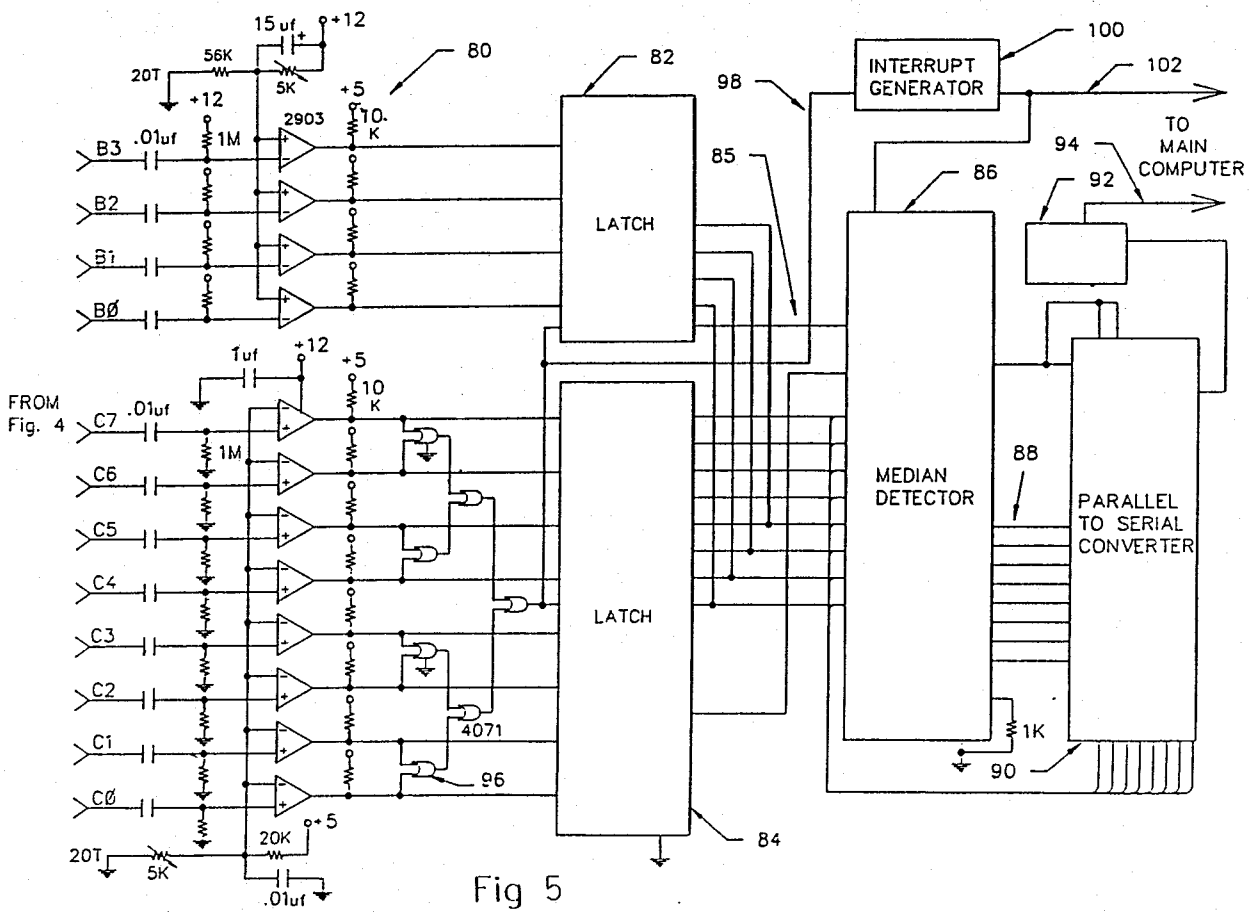
FIG. 5 is a schematic diagram of the rest of the circuitry of the laser receiver.

Terminals B0 through B3 and C0 through C7 are in turn connected to a plurality of comparators 80 (FIG. 5). Terminals B0 through B3 are each connected to the inverting input of the respective comparator 80. The noninverting inputs of the comparators connected to terminals B0 through B3 are connected to a fixed voltage source to establish a reference level. Terminals C0 through C7 each are connected to the noninverting input of their respective comparators 80. The inverting inputs of the comparators 80 connected to terminals C0 through C7 are connected to a fixed voltage source to establish a reference level. In this manner, comparator means 80 provide means for determining the identity of receptors that are receiving light at a predetermined frequency and above a predetermined level. The outputs of comparators 80 are provided as inputs to latch circuits 82 and 84. Latch circuits 82 and 84 store the combination of inputs received from comparators 80 until a next set of inputs are received from comparators 80. The outputs from latches 82 and 84 are provided as inputs to a median detector 86. Median detector 86 is microcomputer programmed to determine, from the inputs received from the output of latches 82 and 84, which of the photo receptors are in a group that are receiving light at an appropriate frequency and above a predetermined level, and from among this group, which is the receptor that is closest to the longitudinal center of the group, as physically arranged in the array.

The N×M matrix is not square in the preferred embodiment. The longer row length allows a larger diameter laser beam to be unambiguously located. If the laser beam diameter illuminated more receptors than M, the control would not be able t precisely identify which receptors will illuminate. Therefore, a trade-off is made to require more interconnection circuitry due to the non-square matrix but to allow larger beam detection. Although the matrix is shown as a two-dimension matrix, a higher dimension may be appropriate for larger quantity of receptors.

The determination made by median detector 86 will correspond to a particular receptor number 1–32. The particular number will be transmitted as a parallel word in ASCII code through output lines 88 to a parallel to serial converter 90. The parallel to serial converter 90 converts the number of the centermost receptor 74 to a serial bit number which is then converted by a second converter 92 to a standard-format, such as RS232, where it is transmitted to the main computer over a coaxial cable 94.

A plurality of OR gates 96 connected to the outputs of comparators 80 form a clock signal 98 which is provided as an input to an interrupt generator 100. The interrupt generator 100 is a one-shot multivibrator that produces a pulse that is distributed on line 102 to the main computer.

When incremental laser receiver 72 intersects a laser plane 68, a group of receptors 74 receive photons from the laser source. Row output terminals B0 through B3, corresponding to the rows that have illuminated receptors 74, will decrease in voltage and the column terminals C0 through C7, corresponding to the columns M having illuminated receptors, will increase in voltage. Comparators 80 will go from a low digital level to a high digital level according to the rows N and columns M that have illuminated receptors. Latches 82 and 84 will store the digital values received from each comparator 80 and will produce those values on their lines 85 going to median detector 86.

Simultaneously with the respective comparators 80 switching state in response to the illuminated receptors, a signal is generated on line 98 from OR gates 96 to cause interrupt generator 100 to generate an individual pulse on line 102. Concurrently, the median detector 86 decodes the inputs received on line 85 from latches 82 and 84 and determines which of the 32 receptors are illuminated. The median detector then assigns the corresponding predetermined integer value of 1–32 to the appropriate receptors that have been determined to be illuminated. The median detector then performs an arithmetic averaging function to determine, of the group of receptors determined to be illuminated, which is the closest to the longitudinal center of the group. For example, if median detector 86 determines that receptors 20–24 are illuminated, it will determine receptor 22 to be the longitudinal centermost receptor of the group. The determination made by detector 86 is outputted on lines 88 as an ASCII Number to parallel to serial converter 90 and ultimately to RS232 format by converter 92.

Therefore, whenever the incremental laser receiver 72 penetrates the laser plane, laser receiver 72 will produce an output on line 94 that is an RS232 representation of a number corresponding to the longitudinally centermost of the group of receptors which is illuminated and will, simultaneously therewith, produce a single pulse on line 102. The illustrated median detector 86 is implemented by an Intel 8749 8-Bit Microcomputer. Illustrated converter 90 is an Intel 8251 Data Format Converter and converter 92 is a standard-bit serial RS232 converter. Interrupt generator 100 is a one-shot pulse generating circuit.

CONTROL SYSTEM ORGANIZATION

Figure 3:
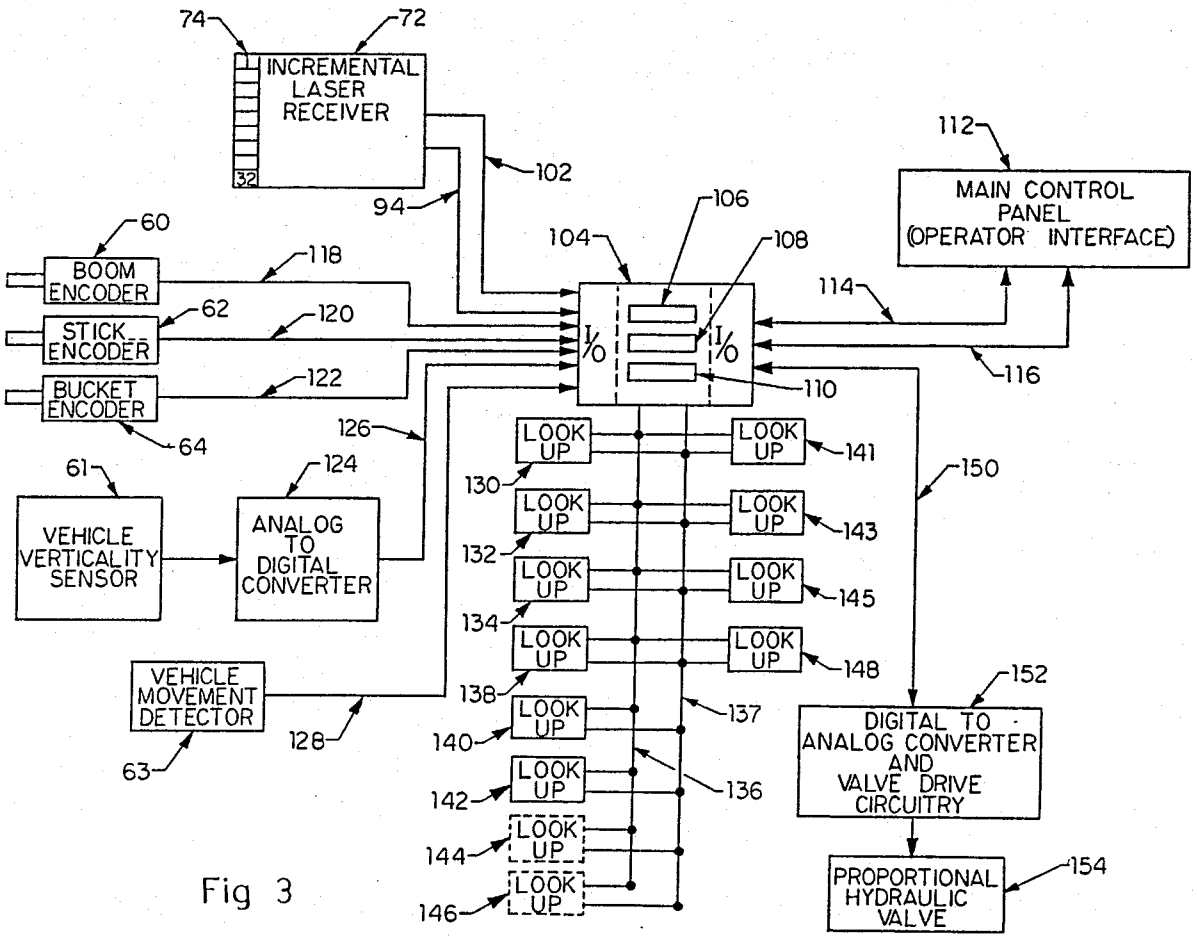
FIG. 3 is a control block diagram showing the interconnection of the components of the invention.

Output lines 94 and 102 from incremental receiver 72 are fed into a central control microcomputer 104 (FIG. 3). Microcomputer 104 has a plurality of registers 106 for storage of variables produced during the control procedure. Computer 104 additionally has a plurality of timers 108 and a clock (not shown) for measuring real-time. Timers 108 are formed in hardware and are hardware decremented without the need for commands in the software program. In addition, a scratch pad memory 110 is provided for storing intermediate results of various calculations and other procedures. Computer 104 has numerous input and output ports (I/O) that are used to interface with a number of input and output devices. Two such ports interface with a main control panel 112 over a pair of lines or buses 114 and 116. Control panel 112, which will be described in more detail below, has its own microcomputer which encodes the positions of the various user input devices to send to the central computer 104 over databus 116. In addition, control panel 112 receives data messages from the central computer over databus 116, decodes these messages and use them to illuminate various lights and displays. Line 114 is a control line shared by computers 104 and 112 to coordinate the sending and receiving of messages.

Each encoder 60, 62 and 64 provides an output on lines or buses 118, 120 and 122, respectively, that is proportional to the length that the respective hydraulic cylinder 54, 56 and 58 is extended from its retracted positions. Lines 118, 120 and 122 are provided as inputs to central computer 104. Encoders 60, 62 and 64 could be of the absolute-position encoding type, which provide an output word corresponding to a unique position of the cylinder. Such a device may be provided either a parallel-bit or a serial-bit output, but the serial-bit output would be preferred to minimize the number of wires extending along connecting means 52. Alternatively, encoders 60, 62 and 64 could be of the incremental encoder type with a quadrature output. Such an encoder produces two phase-shifted output signals that change voltage state in proportion to linear movement. The output of such an incremental encoder only indicates the amount of incremental movement and requires an accumulating device (not shown) to monitor the exact position of the cylinder. Such an accumulating function could be performed by the central computer 104 if desired. Encoders 60, 62 and 64 are provided integrally with a hydraulic cylinder in a device manufactured by Parker Fluidpower Company and sold under Model No. Parkertron CBB2HXLTS13AC60 with Feedback Code A-0-B-2.

Verticality sensor 61 is a potentiometer that provides an analog voltage to an analog to digital converter 124 that, in turn, provides a digital input to computer 104 over a line or bus 126. Vehicle movement detector 63 is a pressure sensing device that produces a digital output having a first state when no hydraulic control pressure is detected and a second state when pressure is detected. The output of detector 63 is provided as an input to computer 104 over line 128. Alternatively, an accelerometer could be used as a motion detector to detect actual frame movement.

Encoders 60, 62 and 64 produce signals or representations that are proportional to the distance that cylinders 54, 56 and 58 are extended from their retracted positions. In order to determine the location of cutting edge 50, computer 104 requires, inter alia, a representation that is proportional to the angular position of boom 28 with respect to frame 22, the angular position of stick 34 with respect to boom 28 and the angular position of bucket 42 with respect to stick 34. The relationship between the output of encoders 60, 62 and 64 to the above mentioned angles is not linear but is, rather, determined by a trigonometric function. In order to provide translation means for translating the length representation from encoders 60, 62 and 64 to the necessary angle representations, lookup tables 130, 132 and 134 are provided Each lookup table provides a multiplicity of values, each value representing the respective angular displacement, or a number related thereto, of the connecting member (boom 28, stick 34 or bucket 42) for each unique value of extension of the respective hydraulic cylinder or a number related thereto. One such lookup table is provided for each encoder. During every loop through the program, computer 104 samples the output from each encoder 60, 62 and 64. These values or numbers related thereto are stored in respective registers. The computer uses an output line or bus 136 to send a data word enabling or addressing the respective lookup table 130, 132 or 134 and containing the value of the respective cylinder length representation or related number. The enabled lookup table has retrieving means for retrieving the value of the angle representation or a number directly related to the angle representation, corresponding to the value read from the encoder. This angle representation, or related number, is transferred to the computer 104 over a databus 137.

The retrieving means used in the preferred embodiment is as follows. The encoder output representation or number is provided to the lookup table as an address word to the respective lookup table. The lookup table responds to the address word by reading out the number that is in the memory location specified by the address.

Each lookup table 130, 132 and 134 is a nonvolatile PROM. The contents therein are developed by calculating, during engineering development of the excavator control, the angle value or a number directly related to the angle value that corresponds to every unique incremental cylinder extension value or a number directly related to the extension value. This calculation would preferably be performed by a computer programmed with an appropriate algorithm. The particular algorithm varies based on the configuration of the hydraulic cylinder and the members to which it is attached, but is a trigonometric function that may be readily determined by one skilled in the art.

In addition to means for translating the length representation from the encoders 60, 62 and 64 to angle representations, the computer has additional lookup tables 138, 140 and 142. As previously mentioned, the position of cutting means 50 is related to the angles between the frame and true vertical, between the frame and the boom, between the boom and the stick and between the stick and the bucket by a trigonometric function. The invention provides that one particular component of the cutting means position, or a number directly related to this component, such as either the vertical distance or the horizontal distance from the boom pivot means, can be obtained directly from a combination of numbers derived from the four above mentioned angle representations or from numbers directly related to the angle representations. Lookup table 138 contains a multiplicity of values, each consisting of the vertical component of the cutting means position corresponding to each unique value of a first respective number or representation that is the angle representation between the frame and the boom adjusted for the deviation of the frame from true vertical or a related number. Likewise, lookup table 140 contains a plurality of values, each consisting of the vertical component of the cutting means position, or a related number, corresponding to each unique value of a second respective number or representation that is a combination of the first number and the angle representation between the boom and the stick or a related number. Likewise, lookup table 142 contains a plurality of values, each consisting of the vertical component of the cutting means position, or a related number, corresponding to each unique value of a third respective number or representation that is a combination of the second number and the angle representation between the stick and the cutting means or a related number.

Lookup tables 130, 132 and 134 translate the values or cylinder extension, or number related thereto, directly to angle representations, or numbers related thereto. However, for lookup tables 138, 140 and 142 the computer 104 must first perform simple addition to combine the respective angle representations to numbers that are trigonometrically related to th component of the cutting means position. After this addition is performed, each resulting number is separately provided on line or bus 136 along with an enabling signal or address for the appropriate lookup table. The respective lookup table has retrieving means that use the data word to locate and read out the corresponding value onto bus 137.

A pair of lookup tables 144 and 146 are provided as alternative lookup tables for table 142. The purpose of the alternative lookup tables is to enable the excavator to be utilized with different size and shaped buckets 42. A switch 168 (FIG. 6) on the control panel allows the operator to indicate which bucket configuration is being used. Computer 104 responds to the position of switch 168 by enabling either lookup table 142, 144 or 146. Additional lookup tables 141, 143, 145 and 148 are provided for functions that will be explained in detail below.

A digital output bus 150 is provided from computer 104 to a digital to analog converter 152. Converter 152 converts a digital signal to an analog signal of the proper impedance to match a proportional hydraulic valve 154. Valve 154 controls the hydraulic fluid supply to boom cylinder 54. Valve 154 responds proportionately to an increasing positive analog signal from converter 152 by moving cylinder 54 in one direction and proportionately to a increasing negative analog voltage from converter 152 by moving cylinder 54 in the opposite direction. While the illustrative embodiment provides a digital to analog converter with appropriate interface circuitry to operate the proportional hydraulic valve, it may be desirable to provide a valve control computer between computer 104 and the digital to analog converter in order to provide a more precise control over the hydraulic valve. Alternatively, a nonproportional fully-open/fully-closed valve could be utilized to provide full actuating hydraulic pressure to move the cylinder 54 in one direction, or alternatively, in the other direction. However, the more precise control provided by the proportional control valve is preferred.

CONTROL PANEL

Figure 6:
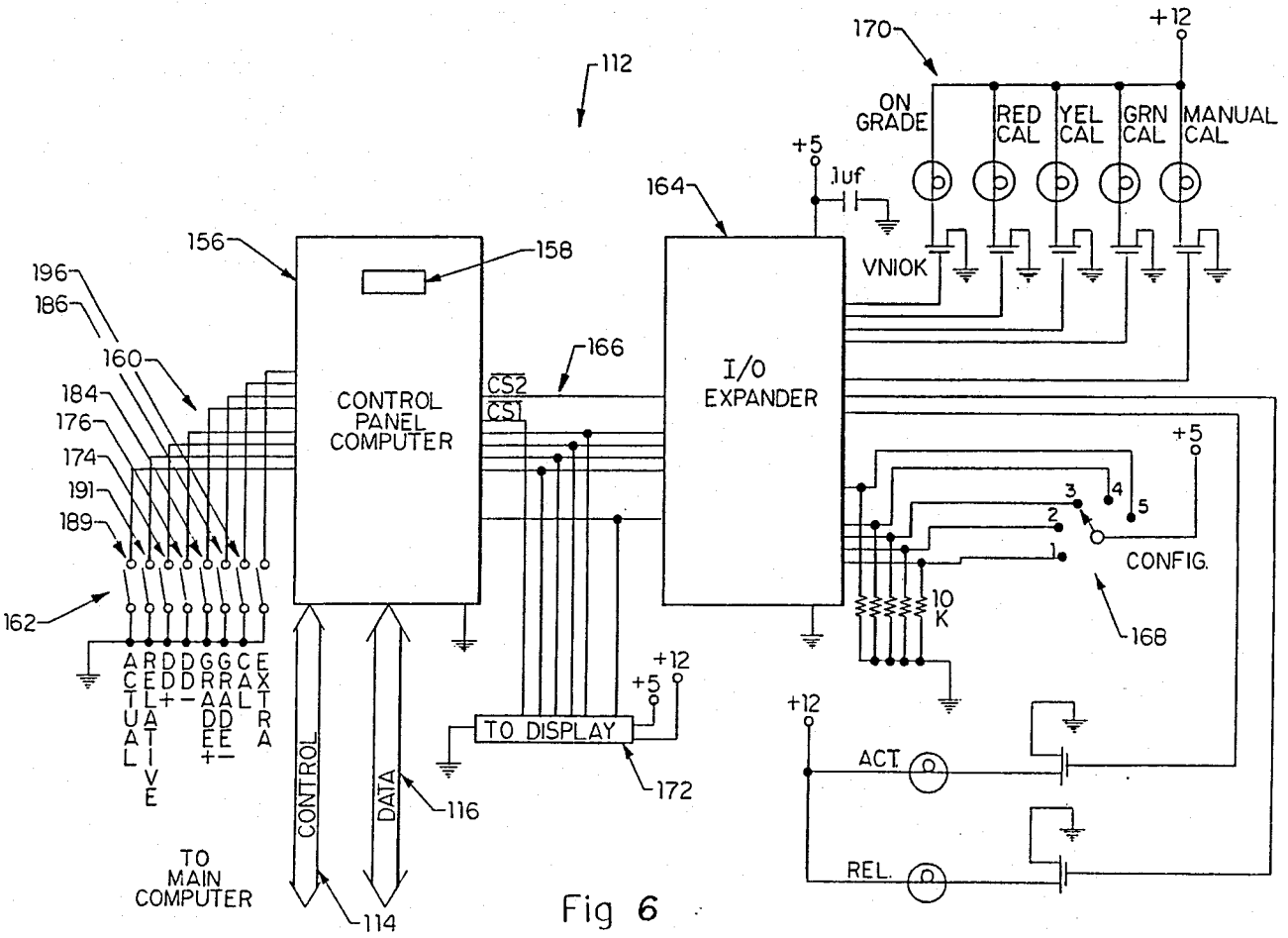
FIG. 6 is a schematic diagram of the control panel.
Figure 10:
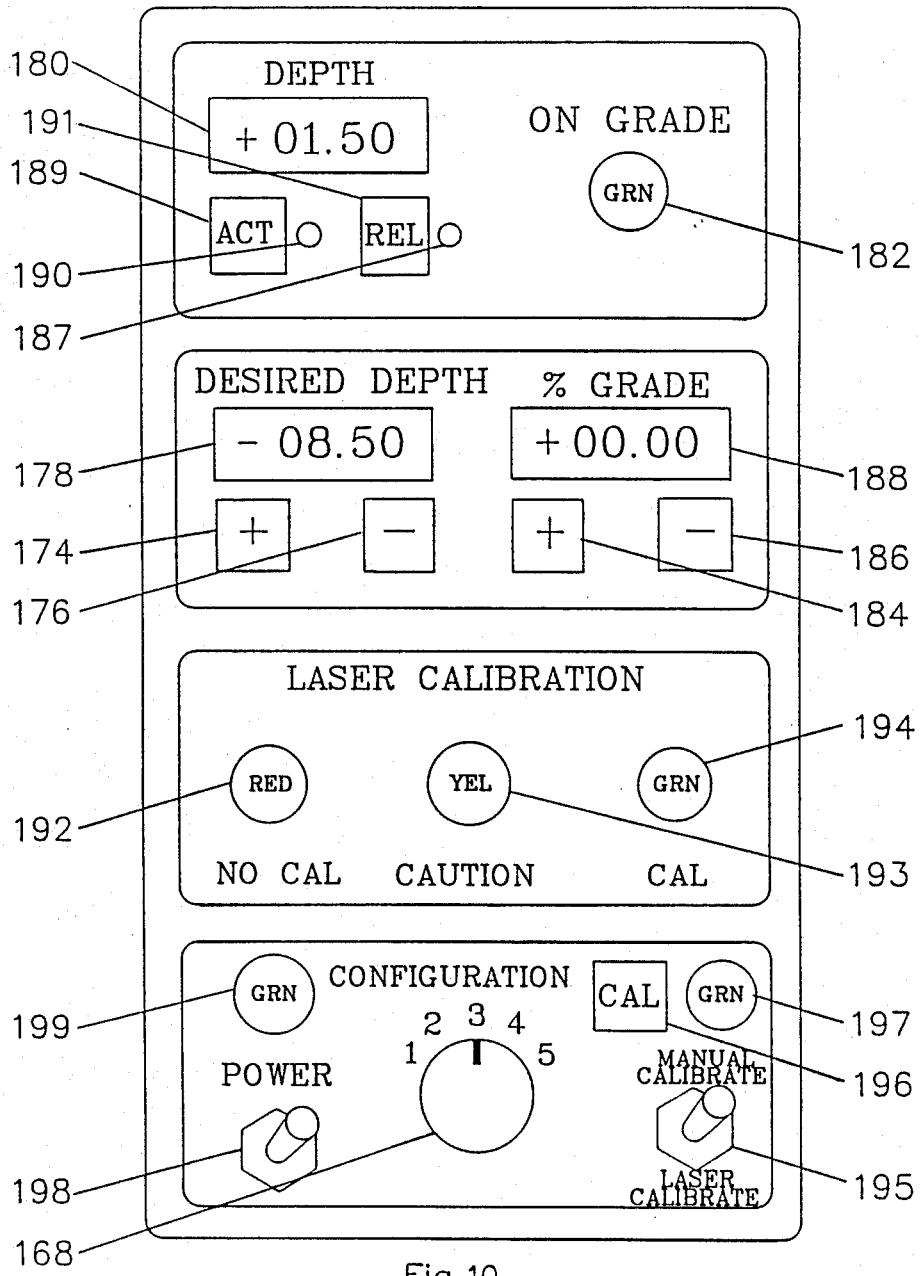
FIG. 10 is a layout of the control panel.

Referring to FIGS. 6 and 10, control panel 112 has a microcomputer 156 with combination input and output ports that are connected to lines or buses 114 and 116 for communication with the central computer 104. Computer 156 monitors the position of the switches on the control panel and forms a data word for transmission to the computer 104 indicative of the position of the switches. In addition, computer 156 receives data words from the main computer and decodes these words in order to illuminate the appropriate lamps and displays. Computer 156 also has a plurality of registers 158 to provide storage for appropriate variables.

Computer 156 receives a series of inputs on lines 160 from switches generally shown at 162. Computer 156 is also connected to an input/output expander circuit 164 by a series of lines 166. Input/output expander 164 provides connection to configuration switch 168 and a plurality of indicators generally shown at 170. Lines 166 are additionally multiplexed to a display assembly 172 which has decoders, display drivers and display elements (not shown).

The desired depth (HTTRGT) is inputted to the panel 126 by a pair of slewing switches 174, 176 which cause computer 156 to increment or decrement a number in a register 158. The current value of HTTRGT is displayed on a display 178 (FIG. 10). The operator determines the desired depth by adding the distance between the laser plane and the grade stake to the desired depth of the cut as measured from the grade stake.

A display 180 indicates the actual vertical distance of the cutting edge from either the laser plane "actual depth" or the final desired depth "relative depth". A pair of switches 189, 190 are for selecting which "depth" indication is displayed. A green "on grade" light 182 indicates when the actual distance between the cutting edge and the laser plane equals the desired distance.

A pair of slewing switches 184 and 186 are provided for incrementing or decrementing the desired percent of grade (PERGRAD) in a register 158 in computer 156. The PERGRAD value is displayed on a display 188. A series of lamps 192, 193 and 194 indicate the laser calibration status of the control. A calibration mode switch 195 has bi-stable positions to select whether the system is to be calibrated manually or by a laser beam. A switch 196 is used to indicate the precise incident of calibration in the manual calibration routine and a green lamp 197 indicates when the control is properly calibrated in the manual mode. A power switch 198 controls power to the entire control system and a light 199 indicates that power is applied.

CONTROL ROUTINE

A. Excavating to Level Grade

Referring to *7a* of the drawings, upon application of power to the computer with the power switch 198 the computer performs a routine to initialize the hardware, reset the various flags and load preestablished values for timers 108 from ROM. The timers 108, which are hardware decremented but reset by software, are started. Control then moves to block 202 where a determination is made whether there has been a change in the status of any input devices from panel 112. If the control determines that there was a change in input status, control moves to a block 204 where the new input information is accepted, both manual and laser calibration mode flags are reset to take the control out of a calibrated mode, and control is returned to block 202. If it is determined that there are no changes in input status then control moves to a block 206 where the control interrogates the PERGRAD register to determine if the number equals exactly 0% (level grade). If it does, then control passes to a block 210 where a grade flag is reset.

If block 206 determines that a nonzero grade number is entered then it is concluded that the operator desires to cut to a sloping grade so control moves to block 208 where a grade flag is set. Control then passes to a block 212 where it is determined whether the vehicle movement detector is activated. If it is, then control moves to block 214 where the laser and the manual calibration mode flags are reset to take the control out of the calibrated mode. The purpose of this is to require that the system be recalibrated if the frame moves, which would indicate that the previously calculated calibration information is no longer valid.

If it is determined in block 212 that the vehicle movement detector is not activated, then control bypasses block 214 and moves to block 216 where it is determined whether calibration switch 195 is in the manual position. If it is determined that switch 195 is in the manual position, control moves to block 218 where it is determined whether the manual calibration flag is set. If it is determined that the manual calibration flag is not set then control passes to block 220 where the control turns off the green "on grade" lamp, turns off the yellow "caution calibration" lamp and turns on the red "no calibration" lamp. Control then passes to block 222 where the D/A converter 152, which controls hydraulic valve 154 provides a zero output, meaning a command to maintain the status quo of the hydraulic valve. If a hydraulic valve control computer is used with the D/A converter 152 then it, rather than the D/A converter, will receive the zero command from block 222. If the control determines in block 218 that the manual calibration flag is set then control passes to block 224 where the computer 104 is instructed to ignore interrupt signals from line 102 and the timer associated with the laser calibration mode. Control then passes to a block 226 where the "manual calibration" lamp is energized and to block 228 where the red "no calibration" lamp is turned off. From bloc 228 control passes to block 236 in FIG. *7c*.

If the control determines in block 216 that calibration switch 195 is not in the manual position, then it is concluded that the switch is in the laser calibration position and control passes to block 230 where the manual calibration flag is reset, and the computer 104 is instructed to respond to interrupt signals from line 102 and the laser calibration mode timer. Control then passes to block 232 where it is determined whether the laser calibration mode flag is set. If it is determined that the laser calibration mode flag is not set then control passes to block 220 where the green and yellow calibration lamps are turned off and the red "no calibration" lamp is turned on. If block 232 determines that the laser calibration mode flag is set then control passes to block 234 where the green laser calibration lamp is turned on and block 228 where the red "no calibration" lamp is turned off. Control then passes to block 236 in FIG. *7c*.

In block 236, the computer is instructed to sample lines 118, 120 and 122 to determine the instantaneous value of the output representations from boom encoder 60, stick encoder 62 and bucket encoder 64. If, alternatively, incremental encoders are utilized rather than absolute position encoders, the computer will sample the accumulating registers that are internally monitoring the extended position of the hydraulic cylinders 54, 56 and 58. Control then passes to block 238 where the control converts CYLBOOM to RABOOM by enabling lookup table 130 and retrieving, over bus 137, the value of RABOOM in table 130 corresponding to the value of CYLBOOM that was obtained in the previous step. A similar conversion of CYLSTIK to RASTIK is performed utilizing lookup table 132 and a conversion of CYLBUCK to RABUCK is performed utilizing lookup table 134.

After the conversion has taken place in block 238, control passes to block 240 where the control samples the value of ANGVERT obtained from analog to digital converter 124 and arithmetically combines it with RABOOM to create ANGBOOM. ANGBOOM is thus a number that is directly dependent on the angle between the frame and the boom, corrected for the offset between the frame and vertical. In block 242, the value of ANGBOOM is used to obtain HTBOOM using lookup table 138. This is performed by the computer enabling lookup table 138 over line 136 and retrieving the value for HTBOOM that corresponds to the value of ANGBOOM that was computed in block 240. The value is transmitted on bus 137 to computer 104 where it is stored in the appropriate register.

Control then passes to block 244 where ANGBOOM is combined with RASTIK to determine ANGSTIK according to the algorithm: ANGSTIK is equal to the sum of ANGBOOM and RASTIK (expressed in degrees) minus 180 degrees. The resulting number is therefore dependent upon both the corrected angle between the frame and the boom and the angle between the boom and the stick. Control then passes to block 246 where the value of HTSTIK corresponding to the value of ANGSTIK calculated in block 244 is selected from lookup table 140. Control then passes to block 248 where the value of ANGSTIK, calculated in block 244, is added to RABUCK minus 180 degrees to obtain the value of ANGBUCK. ANGBUCK is thus seen to depend on the value of the angles between the frame and the boom, corrected for tilt, between the boom and the stick and between the stick and the bucket. From block 248, control then passes to block 250.

In block 250, the control examines the status of a plurality of flags associated with configuration switch 168 to determine the position that switch 168 is in. Control then passes to block 252 where the appropriate lookup table 142, 144, 146 . . . is enabled depending upon the status of the configuration switch flags. Control then passes to block 254 where the value of HTBUCK corresponding to the previously calculated value of ANGBUCK is obtained from the enabled bucket lookup table.

Control then passes to block 256 where the previously established values of HTBOOM, HTSTIK and HTBUCK are algebraically combined, or added, to obtain the value of HTREL. HTREL is proportional to the true vertical distance between the cutting means 50 and the origin, pivot means 32, of the X-Y coordinate system. Control then passes to block 258 where the previously established value of HTREL is algebraically subtracted from the value of HTORIG to obtain HTACT. HTORIG is obtained during a calibration interrupt routine that will be explained in detail below and represents the vertical distance of the origin of the X-Y coordinate system below the laser plane. As a result, the value HTACT is proportional to the true vertical distance that the cutting means is below the laser plane.

Control then passes to block 260 (FIG. 7*d*) where the computer examines the status of the grade flag to determine if it is set. If it is determined that the grade flag is not set, then control passes to block 262 where it is determined whether the value of HTACT is equal to the value of HTTRGT within some predetermined small tolerance. If it is determined that the value of HTACT does equal the value of HTTRGT within tolerance, then the cutting edge 50 has cut to the desired depth and control passes to block 264 (FIG. 7*e*) where the "on grade" lamp is turned on and to block 284 where the D/A converter or hydraulic valve control computer if provided, is provided a zero command. Control then passes to block 268 where either the value of HTACT (actual) or HTACT minus HTTRGT (relative) is displayed on the "depth" indicator 180 on the display panel.

If block 262 determines that the value of HTACT does not equal the value of HTTRGT within tolerance, then control passes to block 270 (FIG. 7*e*) where the "on grade" lamp is turned off, if energized. Control then passes to block 272 where it is determined whether HTACT is within 0.5 feet of HTTRGT. If it is determined that HTACT is within 0.5 feet of HTTRGT, then the cutting means 50 is within 6 inches of the desired depth and control passes to block 274 where it is determined whether the operator is operating the manual boom control and thus attempting to override the automatic control. If the operator is not attempting to override the automatic control, then control passes to block 276 where the control subtracts the value of HTACT from HTTRGT in order to obtain an error signal proportionate to the additional depth that the cutting means must obtain to equal the desired depth. Block 276 provides a comparison means or error means for comparing the true vertical distance of the cutting means from the laser plane with the user-inputted vertical distance from the laser plane that the user desires the cutting means to excavate to. The result of the calculation in block 276 is outputted to the D/A converter or the hydraulic valve control computer whichever is controlling the proportion hydraulic valve 154, so that it will operate the boom cylinder so as to move the cutting edge towards the desired depth. Control then passes to block 268 for display of the value of HTACT or HTACT minus HTTRGT in display 180.

Figure 7A:
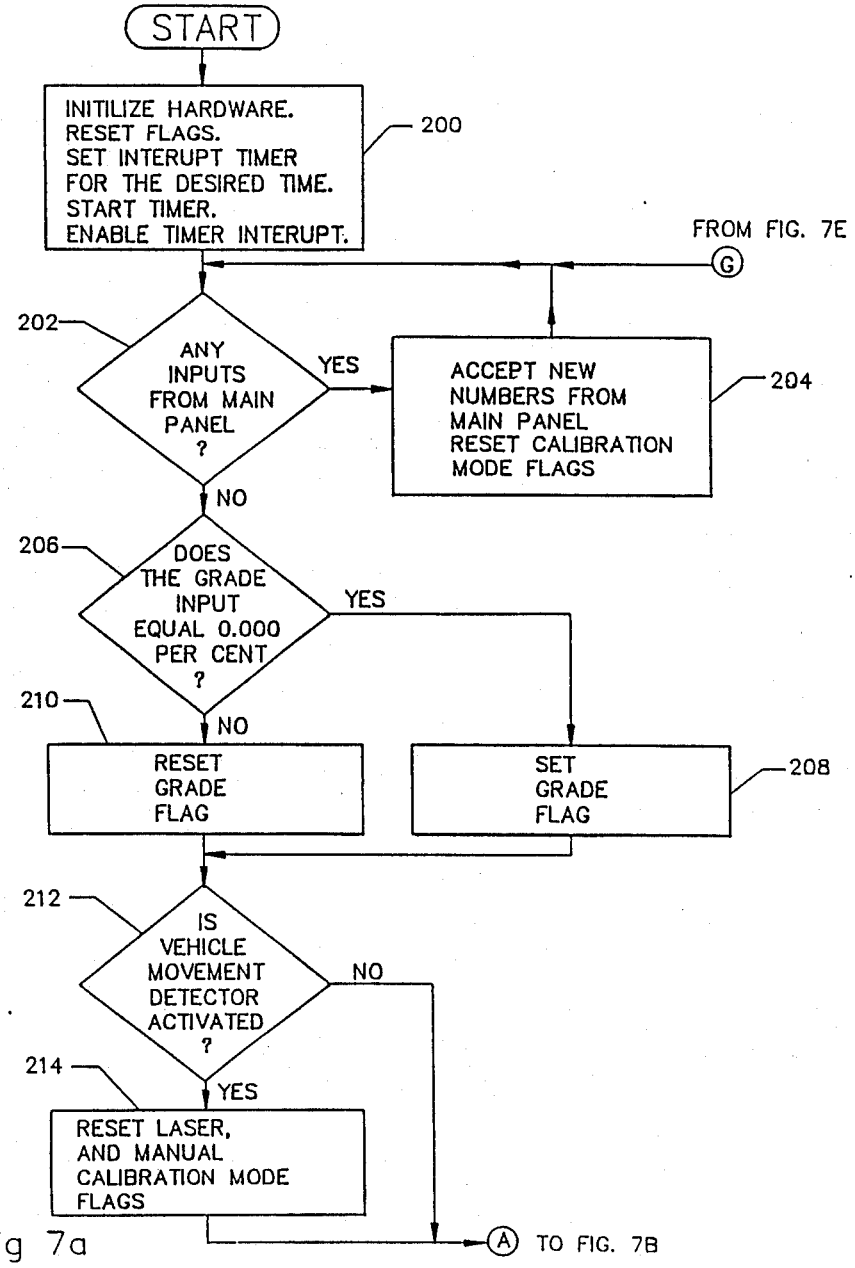
FIGS. 7*a* through 7*e* are a control flow diagram of the main control loop of the present invention.
Figure 7B:
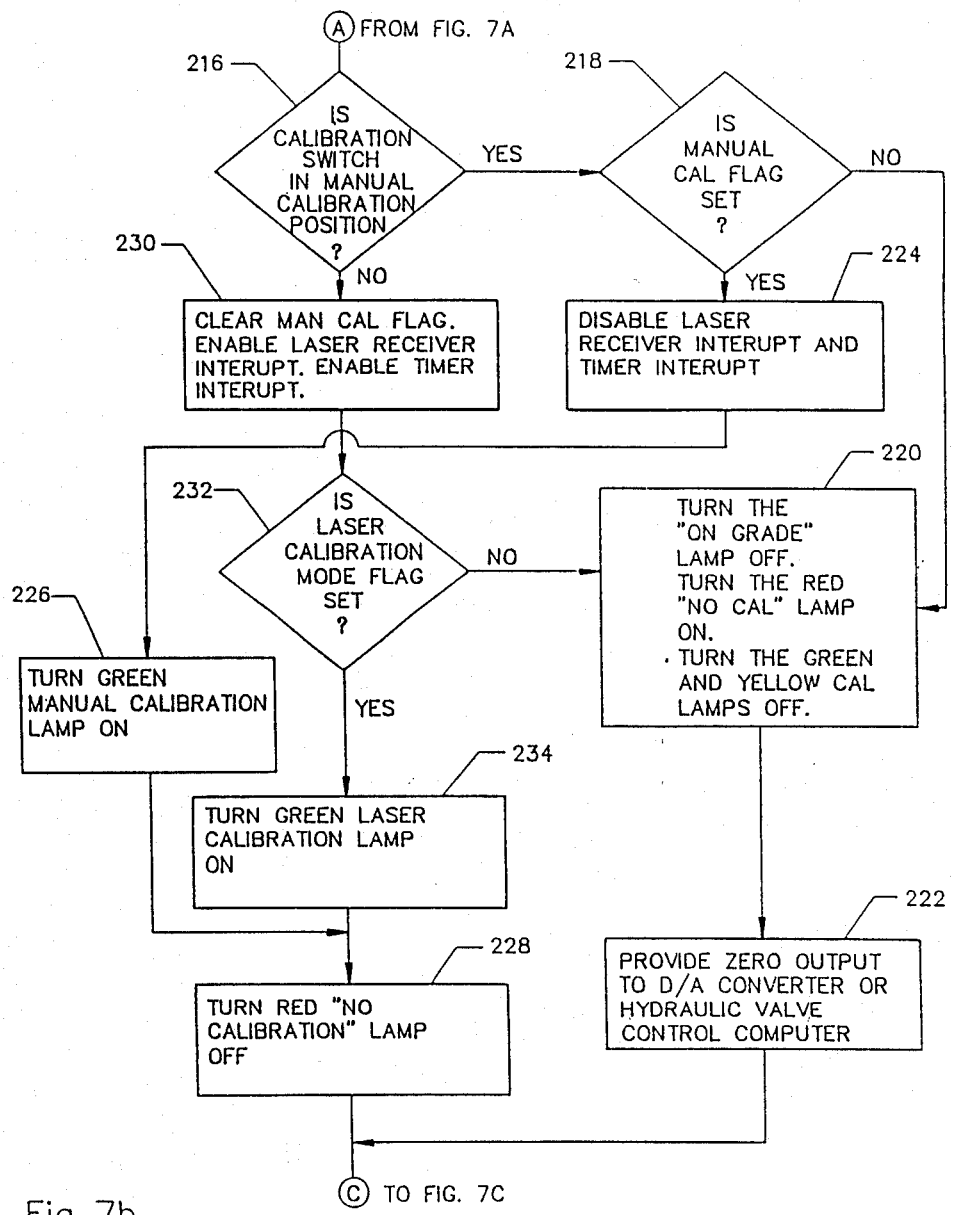
Figure 7C:
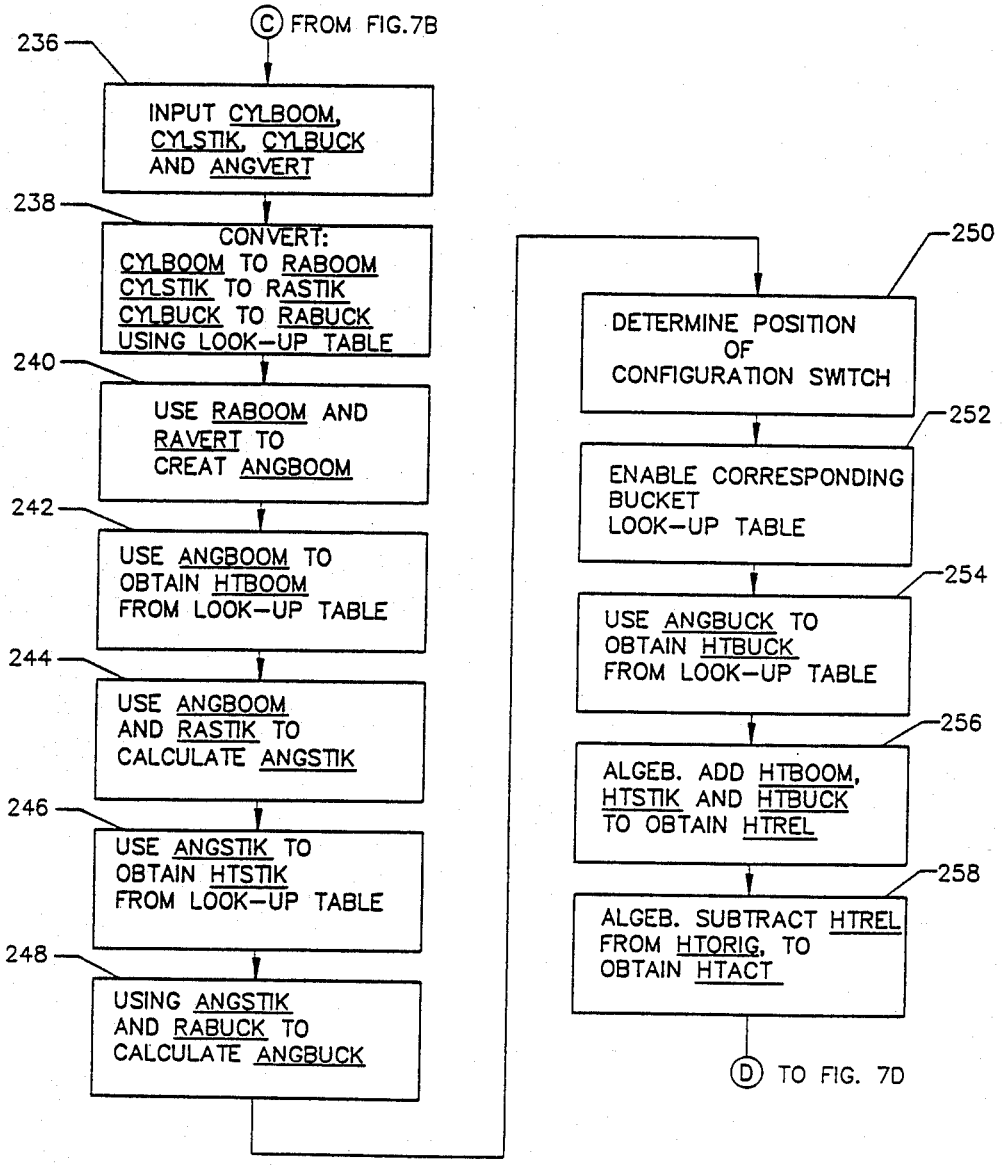
Figure 7D:
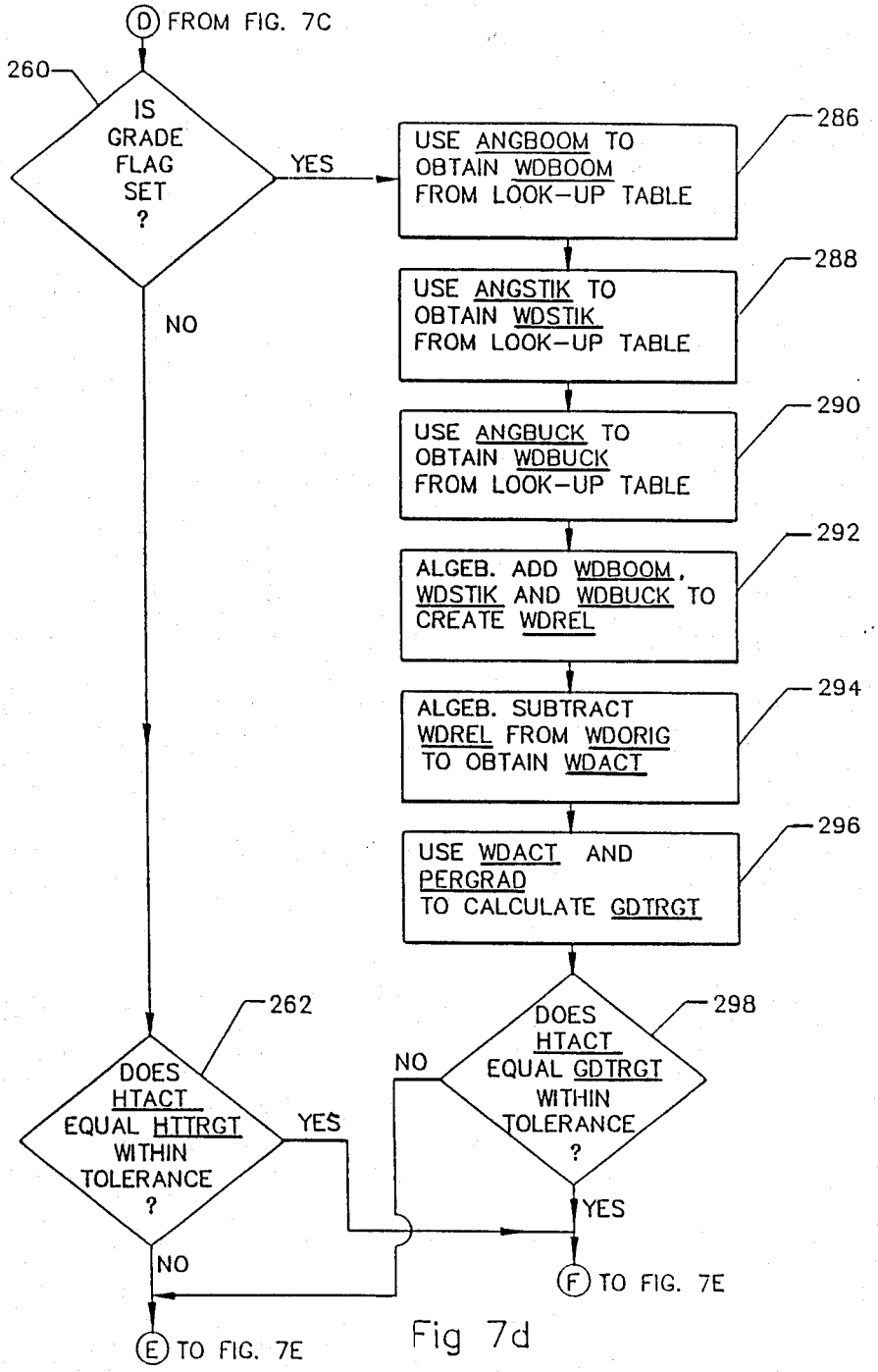
Figure 7E:
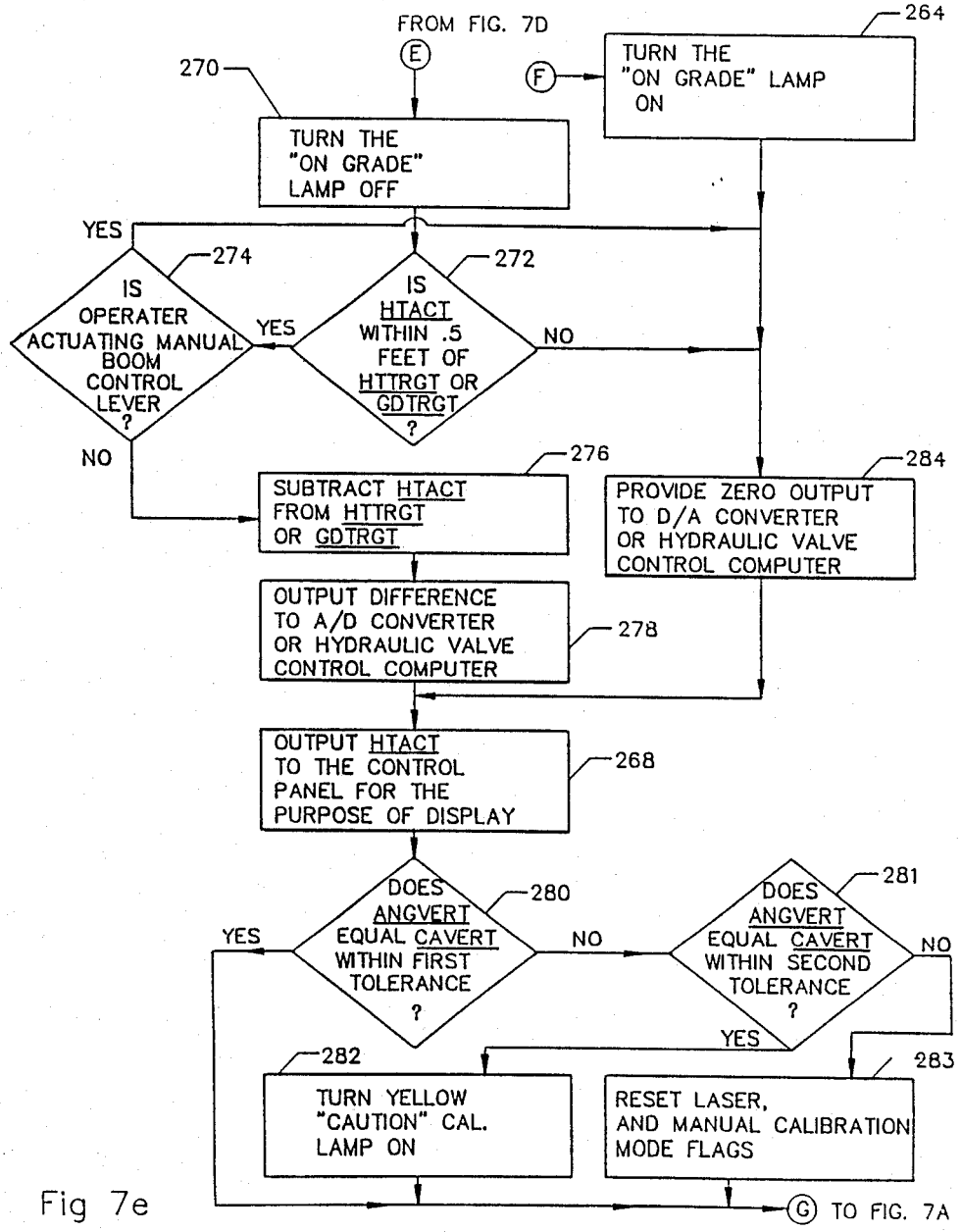

Control then passes to block 280 where it is determined whether the value of ANGVERT equals CAVERT within a first predetermined small tolerance. The purpose of this block is to detect movement of the frame that is insufficient to cause the control to become uncalibrated but which indicates some caution about the validity of the calibration value HTORIG. If it is determined that ANGVERT does equal CAVERT within this first small tolerance, then control passes to the beginning of the loop at block 202 (FIG. 7*a*). If ANGVERT does not equal CAVERT within the first small tolerance then control moves to block 281 where the control determines whether ANGVERT equals CAVERT within a second tolerance that is larger than the first tolerance. If ANGVERT equal CAVERT within the second tolerance then a yellow "caution calibration" lamp is energized in block 282. If ANGVERT does not equal CAVERT within the second tolerance then control passes to block 283 where the laser and manual calibration mode flags are reset to take the control out of the calibrated mode.

If block 272 (FIG. 7*e*) determines that HTACT is not within 0.5 feet of HTTRGT, then control passes to block 284 where the D/A converter or the hydraulic valve control computer is provided a zero output. It should be noted that the present invention is directed to a control capable of excavating to a predetermined depth. It is the intention of the inventors that the operator should exert general control over the stick and bucket, so control is only exercised automatically by the computer when the cutting edge 50 is within 0.5 feet of the desired depth. Similarly, if block 274 determines that the operator is attempting to manually override the automatic control, then control will pass from block 274 to 284 where the automatic control will be disabled even if within 5 feet of the desired depth to return control to the operator.

B. Excavating on a Sloping Grade

If the operator desires to cut a trench on a sloping grade, as is normal for laying tile and other drain pipe, then the laser orientation will be adjusted to direct the laser plane parallel the desired grade slope, or percent of grade. The desired percent of grade, in terms of feet of elevation per horizontal foot of length, is entered using slewing switches 184 and 186 to control the number in the PERGRAD register and the number displayed by display 188. With a value of PERGRAD other than 0, the control will determine at block 206

(FIG. 7*a*) that a grade input equal to other than 0% has been entered and control will pass to block 208 where the grade flag will be set.

If block 260 (FIG. 7*d*) determines that the grade flag is set, then control passes to block 286 where the control converts the value of ANGBOOM, calculated previously in block 240, to the corresponding value of WDBOOM using a lookup table 141.

When it is desired to cut a trench on a grade then the horizontal position of the cutting edge becomes a necessary variable because the desired depth of the trench varies according to the horizontal position of the cutting edge. Just as the vertical distance of the cutting edge with respect to the boom pivot 32 is related to the angle between the boom and the frame adjusted for frame tilt, the horizontal distance between the cutting edge and pivot 32 is, likewise, related to the angle between the boom and the frame adjusted for frame tilt. Therefore, the value of WDBOOM is obtained from a lookup table 141 containing a multiplicity of values of WDBOOM, each value corresponding to a respective value of ANGBOOM.

From block 286, control moves to a block 288 where the value of WDSTIK, corresponding to the value of ANGSTIK calculated in block 244, is obtained from a lookup table 143. Control then passes to block 290 where the value of WDBUCK, corresponding to the value ANGBUCK calculated in block 248 is obtained from a lookup table 145. In block 292, the previously obtained values of WDBOOM, WDSTIK and WDBUCK are algebraically combined to create the value WDREL, which is proportional to the horizontal distance from boom pivot 32 to the cutting edge 50. Control then passes to block 294 where the value of WDREL is subtracted from the value of WDORIG to obtain the value WDACT which represents the horizontal distance of the cutting edge from the position it was in the most recent instant the laser receiver crossed the laser plane, i.e., at calibration.

As previously mentioned, when cutting a trench on grade, the desired depth of the cut varies with horizontal distance. Therefore, for each pass through the program when a nonzero value of the grade is inputted to the control, block 296 adjusts the desired depth or HTTRGT according to the horizontal distance the cutting edge is from the position at calibration (WDACT) and the percentage grade number entered by the operator (PERGRAD). The resulting value of GDTRGT represents a desired depth that varies according to the horizontal position of the cutting edge 50. Once GDTRGT is determined for the particular loop in software, control passes to block 298 where it is determined whether HTACT is equal to GDTRGT within a predetermined small tolerance. If it is determined that HTACT is equal to GDTRGT within tolerance, then control passes to block 264 (FIG. 7*e*) where the "on grade" lamp is energized and block 284 where the D/A converter is provided a zero output. If block 298 determines that HTACT does not equal GDTRGT within tolerance then control passes to block 270 (FIG. 7*e*) where the "on grade" lamp is turned off, if it is on, and control passes to block 272 where it is determined whether HTACT is within 0.5 feet of GDTRGT. If it is, then HTACT is subtracted from GDTRGT in block 276 and the difference is outputted to the D/A converter to operate the proportional hydraulic valve. If the value of HTACT is not within 0.5 feet of GDTRGT or if the operator is manually attempting to override the automatic control, then control block 284 provides a zero output to the D/A converter.

C. Laser Calibration Routine

Figure 8A:
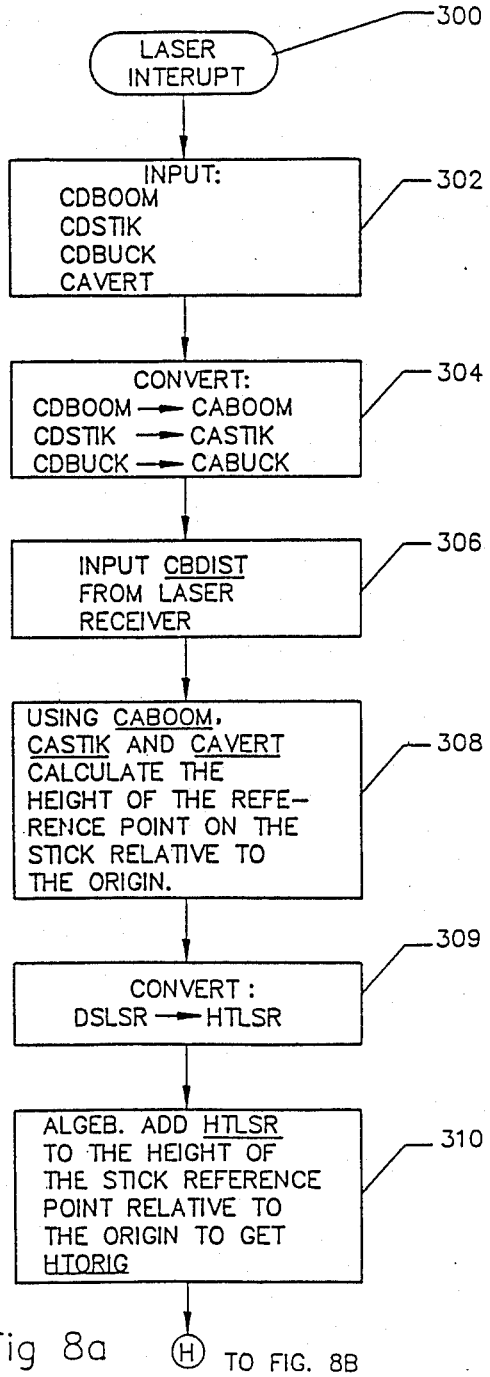
FIGS. 8*a* and 8*b* are control flow diagrams of the laser calibration interrupt routine.
Figure 8B:
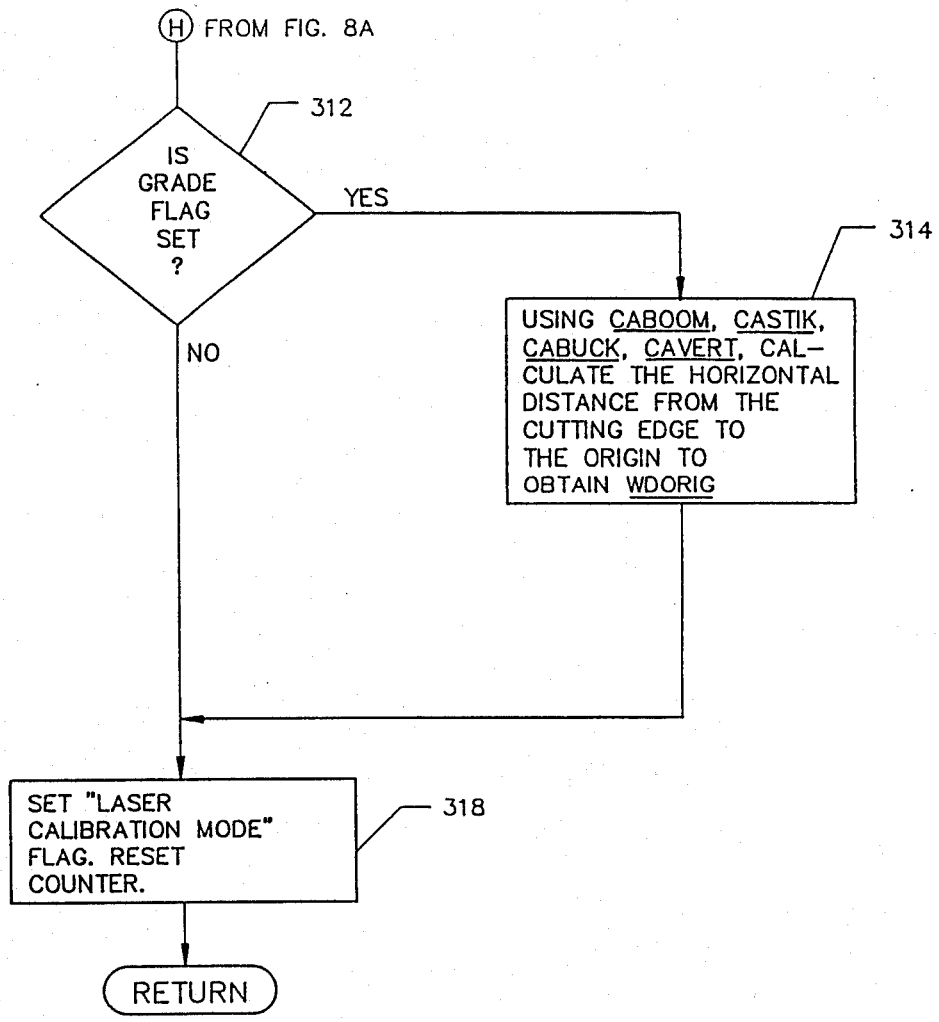

As explained above, the incremental laser receiver 72 generates a number that represents the longitudinally centermost receptor of the group cells that are illuminated by the laser on line 94 and an interrupt signal on line 102 at the precise moment that the beam strikes the receiver When the microcomputer 104 receives an interrupt signal on line 102 it interrupts the operation of the main control program in FIG. 7 and performs the interrupt routine shown in FIGS. 8*a* and 8*b*.

Receipt of the interrupt signal 102 in block 300 causes the microcomputer to examine lines 118, 120 and 122 to obtain the value of the outputs or representations from encoders 60, 62 and 64 which are proportional to the length that the boom, stick and bucket cylinders are extended Block 302 additionally examines line 126 to obtain the output from the verticality sensor. Control then passes to block 304 where the values of CDBOOM, CDSTIK and CDBUCK are converted to CABOOM, CASTIK and CABUCK, respectively, using lookup tables 130, 132 and 134. Control then passes to block 306 where the value of CBDIST obtained on line 94, simultaneous with the interrupt signal, is examined. The value CBDIST is the assigned number of the median laser receptor cell at the instant of the laser flash and is proportionate to the height on the receiver that the laser beam strikes the receiver.

In block 308, the value of CABOOM, CASTIK, CAVERT and LNSTIK are used to determine the vertical distance of the reference point on the stick from the origin using the same control procedure used in blocks 240 to 246 to obtain the vertical distance of the distal end of the stick from the origin, except that the constant LNSTIK is subtracted from the result obtained in the block 246 portion of the procedure because the reference point is located only part of the length between the distal end of the boom and the distal end of the stick.

Because the stick, and therefore the laser receiver, may not be perpendicular to the laser plane when passing through it, the distance from the median laser receptor to the reference point on the stick may need to be adjusted to compensate for this lack of perpendicularity. This relationship is again a trigonometric function and, therefore, a lookup table 148 is used to convert DSLSR to HTLSR. Control then passes to block 310 where the value of HTLSR, determined in block 309, is algebraically added to the height of the stick reference point relative to the origin in order to obtain the calibration number of HTORIG. The value of HTORIG will be stored in its respective register and represents the vertical distance of the origin from the laser plane.

Control then passes to block 312 where the control determines whether the grade flag is set. When a percent of grade number other than zero is inputted to the computer through switches 184 and 186, the grade flag will be set Because the calibration mode requires monitoring the horizontal as well as the vertical positions of the cutting edge, the horizontal position of the origin or pivot point 32 must be established with respect to a reference. The reference will be the horizontal position of the cutting edge at the instant of the laser striking the receiver. This position of the cutting edge does not correspond to any predetermined location in the earth-coordinate system. Such correspondence is not necessary because only the amount of relative horizontal movement of the cutting edge, during sloping grade digging, is important. The laser, which is inclined so as to be parallel with the final grade, will adjust the vertical component of the desired depth (GDTRGT) for horizontal displacement during every calibration procedure. However, the control needs to internally adjust this vertical component (GDTRGT) for relative horizontal displacement between calibration procedures.

If it is determined in block 312 that the grade flag is set, then control passes to block 314 where the horizontal distance of the cutting edge from the origin is obtained by using the values of CABOOM, CASTIK, CABUCK and CAVERT determined in block 304 along with the procedure in blocks 240 through 256. However, blocks 250 and 252 are omitted because the same horizontal lookup table is used for all bucket configurations and lookup tables 141, 143 and 145 are used instead of lookup tables 138, 140 and 142 to obtain the horizontal component of the cutting edge position that corresponds to the number related to the respective angles.

Control then passes to block 318 where the laser calibration mode flag is set and the counter that monitors the time between calibration operations is reset. Control then returns to the point in the main loop where it had exited.

D. Manual Calibration

Figure 9:
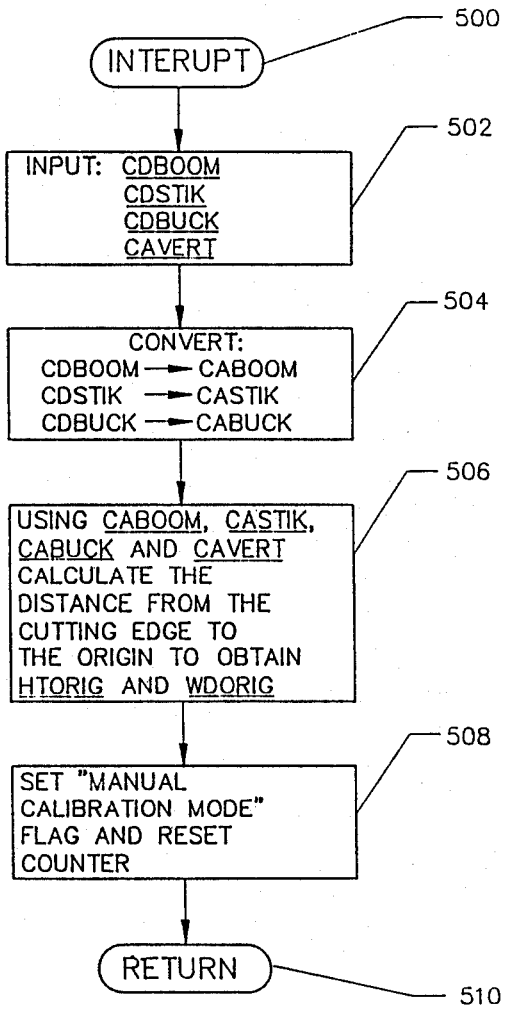
FIG. 9 is a control flow diagram of the manual calibration interrupt routine.

When it is desired to utilize the excavator without a laser, many of the advantages of the invention can still be realized. To perform a manual (without laser) calibration procedure, as illustrated in FIG. 9, the cutting edge is brought into contact with a grade stake or other indication of vertical height. When this has been accomplished, the calibration button 196 is pressed which generates an interrupt signal 500 which causes control to exit the main loop and pass into an interrupt loop. Control then passes to block 502 where inputs CDBOOM, CDSTIK, CDBUCK and CAVERT (which relate to the instant the manual calibration button is pressed) are inputted. Control then passes to block 504 where the values are converted to CABOOM, CASTIK and CABUCK. Control then passes to block 506 where the vertical and horizontal distances from the cutting edge to the origin are calculated according to the control procedures in blocks 240–256. The resulting HTORIG and WDORIG are stored and control passes to block 508 where the manual calibration mode flag is set and the counter that monitors the time between calibration cycles is reset. Control then returns to the portion of the program where it had exited. This routine will provide manual calibration for both level grade and sloping grade cutting procedures.

Of course, it is understood that the above is merely a preferred embodiment of the invention. Changes and modifications in the specifically described embodiments can be carried out without departing from the scope of the invention. For example, the calibration technique could be utilized with commercially available angular displacement encoders provided for monitoring the angles between the excavator members. Also, the use of linear encoders monitoring the length of cylinders to obtain a representation of angular displacement could be utilized in other control systems. One skilled in the art may choose to store various trigonometric tables in the lookup tables and apply the signals derived from the cylinder length encoders to the tables after some initial calculating steps. Similarly, the lookup table approach to real-time solutions of complicated algorithms may be used in other applications.

In addition, the desired cutting depth technique could be combined with other inputs to, for example, avoid coming into contact with underground or overhead cables. It additionally may be desirable to monitor the rate of change of the extension of the hydraulic cylinders to modulate the proportional hydraulic valve in order to more closely control the approach of the cutting edge to the desired depth according to the rate of movement of the stick and bucket under manual control.

It is to be emphasized that the invention is usable with other known excavator control techniques, such as ones that memorize and repeat a particular routine such as loading dirt to a truck, and cause the bucket to be returned to the trench. The invention is intended to encompass all such variations and to be limited only by the scope of the appended claims and all equivalents to which are entitled as a matter of law.

The embodiments of the invention in which an exclusive property or privilege is claimed are defined as follows:

1. A system for an excavator for use with a laser emitting a planar laser beam at a predetermined elevation, said excavator having a fame, cutting means, connecting means for connecting said cutting means to said frame and actuation means for moving said cutting means with respect to a point on said frame, said connecting means including a stick member movable with respect to said frame and a bucket movable with respect to said stick member, said system comprising:

laser receiving means on said stick member for producing a signal when contracted by the laser beam;

laser receiving means relative position determining means for producing a first representation proportional to the distance between said laser receiving means when contacted by the laser beam and said point;

means for storing said first representation;

cutting means relative position determining means for determining the distance between said cutting means and said point at different positions of said bucket relative to said stick member and producing a second representation proportional to the distance between said cutting means and said point; and cutting means absolute position determining means for combining said first and second representations to produce a third representation proportional to the distance of said cutting means from the laser plane.

2. A system for an excavator for use with a laser emitting a planar laser beam at a predetermined elevation, said excavator having a fame, cutting means, connecting means for connecting said cutting means to said frame and actuation means for moving said cutting means with respect to a point on said frame, said system comprising:

laser receiving means on said connecting means for producing a signal when contacted by the laser beam;

laser receiving means relative position determining means for producing a first representation proportional to the distance between said laser receiving means when contact by the laser beam and said point;

means for storing said first representation;

cutting means relative position determining means for producing a second representation proportional to the distance between said cutting means and said point; and cutting means absolute position determining means for combining said first and second representations to produce a third representation proportional to the distance of said cutting means from the laser plane; and automatic control means responsive to aid third representation for producing a first output for controlling said actuation means.

3. The system in claim 2 further having a desired distance storage means for storing a user-inputted fourth representation proportional to the distance from the laser plane the user desires said cutting means to excavate to and wherein said automatic control means further has comparison means for comparing said third and fourth representations and further wherein said actuation means has means for causing, based on said first output, said cutting means to approach said desired distance.

4. The system in claim 3 further having manually operable control means for producing a second output, said second output also controlling said actuation means, and enabling means for enabling said first output only when said comparison means determines that said cutting means is within a predetermined distance from said desired distance.

5. The system in claim 4 wherein said predetermined distance is about 6 inches.

6. A system for an excavator for use with a laser emitting a planar laser beam at a predetermined elevation, said excavator having a frame, cutting means, connecting means for connecting said cutting means to said frame and actuation means for moving said cutting means with respect to a point on said frame, said system comprising:

laser receiving means on said connecting means for producing a signal when contacted by the laser beam;

laser receiving means relative position determining means for producing a first representation proportional to the distance between said laser receiving means when contacted by the laser beam and said point;

means for storing said first representation;

cutting means relative position determining means for producing a second representation proportional to the distance between said cutting means and said point; and cutting means absolute position determining means for combining said first and second representations to produce a third representation proportional to the distance of said cutting means from the laser plane;

wherein said laser receiving means comprises a linear array of laser receptors and wherein said signal comprises a fourth representation proportional to the distance from a preselected reference point on said connecting means to a single receptor contacted by a laser beam and further wherein said fourth representation is proportional to the distance from said preselected reference point to the longitudinally centermost receptor in a group of receptors contacted by a laser beam.

7. The system in claim 6 wherein said laser receiving means further includes interrupt generating means for producing an indication coincidental with any of said receptors being contacted by a laser beam.

8. The system in claim 7 further including a computer having a control loop and means, responsive to an indication from said interrupt generating means, for causing said computer to interrupt said control loop.

9. A system for an excavator for use with a laser emitting a planar laser beam at a predetermined elevation, said excavator having a frame, cutting means, connecting means for connecting said cutting means to said frame and actuation means for moving said cutting means with respect to a point on said frame, said connecting means including a boom pivotally mounted at a proximal end thereof to said frame, a stick pivotally mounted at a proximal end thereof to a distal end of said boom and a bucket pivotally mounted at a proximal end thereof to a distal end of said stick, a distal end of said boom and a bucket pivotally mounted at a proximal end thereof to a distal end of said stick, a distal end of said bucket defining said cutting means and wherein said laser receiving means is on said stick, said system comprising:

laser receiving means on said connecting means for producing a signal when contacted by the laser beam;

laser receiving means relative position determining means for producing a first representation proportional to the distance between said laser receiving means when contacted by the laser beam and said point;

means for storing said first representation;

cutting means relative position determining means for producing a second representation proportional to the distance between said cutting means and said point; and cutting means absolute position determining means for combining said first and second representations to produce a third representation proportional to the distance of said cutting means from the laser plane;

wherein said laser receiving means relative position sensing means comprises a vertically sensing means for producing a first angle representation proportional to the angle between said frame and a true vertical plane, a boom angle sensing means for producing a second angle representation proportional to the angle between said frame and said boom, a stick angle sensing means for producing a third angle representation proportional to the angle between said boom and said stick and calculating means for calculating said laser receiving means relative position from said angle representations.

10. The system in claim 9 wherein said calculating means comprises means for combining said first and second angle representations to produce a fourth angle representation, means for combining said third and fourth angle representations to produce a fifth angle representations, first linkup table means for converting said fourth angle representation to a first portion of said laser receiving means relative position, second lookup table means for converting said fifth angle representation to a second portion of said laser receiving means relative position and means for combining said portions.

11. The system in claim 10 wherein said laser receiving means comprises a linear array of laser receptors, and means for producing a signal that is proportional to the distance from a preselected reference point on said stick to a single receptor that is the centermost said receptor in a group of said receptors contacted by the laser beam and further wherein said calculating means comprises means for combining said signal with said portions.

12. The system in claim 10 further having a bucket angle sensing means for producing a sixth angle representation proportional to the angle between said stick and said bucket and means for combining said fifth and sixth angle representations to produce a seventh angle representation and wherein said cutting means relative position sensing means comprises a third lookup table means for converting said seventh angle representation to a portion of said cutting means relative position and means for combining said portion of said cutting means relative position with said portions of said laser receiving means relative position.

13. A method of operating an excavator having a frame, cutting means, connecting means for connecting said cutting means to said frame and actuation means for moving said cutting means with respect to a first point on said frame, said method comprising the steps:

establishing a reference plane at a preselected orientation to a preselected coordinate system;

selecting a second point on said connecting means;

operating said actuation means in a manner that occasionally causes a momentary coincidence between said second point and said plane;

producing a first representation proportional to the distance between said first and second points simultaneous with each said momentary coincidence;

storing said first representation as a calibration number;

producing second representations repetitively between occurrences of said momentary coincidences, said second representations being proportional to the distance between said cutting means and said first point;

comparing said second representations with said calibration number to repetitively produce third representations proportional to the distance of said cutting means from said reference plane; and updating said calibration number after each said momentary coincidence.

14. The method in claim 13 wherein said preselected coordinate system is the earth and wherein said step of establishing comprises generating an angularly rotating laser beam in said reference plane.

15. A method of operating an excavator having a frame, cutting means, connecting means for connecting said cutting means to said frame and actuation means for moving said cutting means with respect to a first point on said frame, said method comprising the steps:

establishing a reference plane by generating an angularly rotating laser beam in said reference plane at a preselected orientation with respect to earth;

selecting a second point on said connecting means;

operating said actuation means to cause a momentary coincidence between said second point and said plane;

producing a first representation proportional to the distance between said first and second points simultaneous with said coincidence;

storing said first representation;

producing a second representation proportion al the distance between said cutting means and said fist point;

combining said first and second representations to produce a third representation whereby the third representation will be proportional to the distance of said cutting means from said reference plane;

wherein said step of operating comprises operating said excavator in a manner that causes said connecting means to occasionally cross said reference plane without pausing while crossing said plane.

16. The method in claim 15 wherein said step of selecting comprises locating a laser receiver on said connecting means said laser receiver operable to produce a first signal simultaneous with said coincidence in response to said laser beam.

17. The method in claim 16 wherein said laser receiver comprises a plurality of linearly disposed laser receptors and wherein said step of selecting comprises producing a second signal indicative of the identity of a said receptor contacting said laser beam and wherein said second point comprising said receptor contacting said laser beam.

18. The method in claim 17 wherein said second signal is indicative of the centermost of a plurality of said receptors contacting said laser beam.

19. A method of operating an excavator having a frame, cutting means, connecting means for connecting said cutting means to said frame and actuation means for moving said cutting means with respect to a first point on said frame said method comprising the steps:

establishing a reference plane by generating an angularly rotating laser beam in said reference plane at a preselected orientation with respect to earth;

selecting a second point on said connecting means;

operating said actuation means to cause a momentary coincidence between said second point and said plane;

producing a first representation proportional to the distance between said first and second point simultaneous with said coincidence;

storing said first representation;

producing a second representation proportional to the distance between said cutting means and said first point;

combining said first and second representations to produce a third representation whereby the third representation will be proportional to the distance of said cutting means from said reference plane; and selecting a desired distance from said reference plane that it is desired for said cutting means to excavate to, comparing said third representation with said desired distance and controlling said actuation means so as to cause said cutting means to approach said desired distance.

20. The method in claim 19 wherein said step of establishing includes establishing a reference plane that is generally horizontal whereby the cutting means will excavate to a level grade.

21. The method in claim 19 wherein said step of establishing a reference plane includes establishing a reference plane that is inclined with respect to the horizon whereby said cutting means will excavate to a nonlevel grade generally parallel said reference plane.

22. The method in claim 21 wherein said first representation comprises first vertical and first horizontal components of the said distance between said first and second points, said second representation comprises second vertical and second horizontal components of said distance between said cutting means and said first point, and wherein said step of combining comprises combining the said vertical components and the said horizontal components to produce a third representation having third vertical and third horizontal components.

23. The method in claim 22 further comprising the steps of monitoring said second horizontal component and adjusting said desired distance proportionate to the percentage said plane is inclined and to said second horizontal component whereby the cutting means will excavate to said nonlevel grade between successive ones of said coincidence.

* * * * *

UNITED STATES PATENT AND TRADEMARK OFFICE

CERTIFICATE OF CORRECTION

PATENT NO. : 4,829,418

DATED : May 9, 1989

INVENTOR(S) : Edward G. Nielsen & Timothy E. Steenwyk

It is certified that error appears in the above-identified patent and that said Letters Patent is hereby corrected as shown below:

Column 2, line 59:

"th" should be --the--;

Column 10, line 41:

"t" should be --to--;

Column 12, line 53:

After "provided" insert --.--;

Column 13, line 68:

"th" should be --the--;

Column 18, line 35:

"equal" should be --equals--;

Column 22, Claim 1, line 26:

"fame" should be --frame--;

Column 22, Claim 1, line 34:

"contracted" should be --contacted--;

Column 22, Claim 2, line 66:

"contact" should be --contacted--;

UNITED STATES PATENT AND TRADEMARK OFFICE

CERTIFICATE OF CORRECTION

PATENT NO. : 4,829,418

DATED : May 9, 1989

INVENTOR(S) : Edward G. Nielsen & Timothy E. Steenwyk

It is certified that error appears in the above-identified patent and that said Letters Patent is hereby corrected as shown below:

Column 23, Claim 2, line 10:

"aid" should be --said--;

Column 24, Claim 10, line 54:

"linkup" should be --lookup--;

Column 25, Claim 15, line 64:

"proportion al" should be --proportional--;

Column 25, Claim 15, line 65:

"fist" should be --first--.

Signed and Sealed this

Fourth Day of December, 1990

*Attest:*

HARRY F. MANBECK, JR.

*Attesting Officer*

*Commissioner of Patents and Trademarks*